US010265609B2

(12) United States Patent
Maharbiz et al.

(10) Patent No.: US 10,265,609 B2
(45) Date of Patent: Apr. 23, 2019

(54) INTELLIGENT GAME SYSTEM FOR PUTTING INTELLIGENCE INTO BOARD AND TABLETOP GAMES INCLUDING MINIATURES

(75) Inventors: Michel Martin Maharbiz, El Cerrito, CA (US); Steve Jaqua, Ann Arbor, MI (US)

(73) Assignee: Tweedletech, LLC, Ann Arbor, MI (US)

( * ) Notice: Subject to any disclaimer, the term of this patent is extended or adjusted under 35 U.S.C. 154(b) by 0 days.

(21) Appl. No.: 12/476,888

(22) Filed: Jun. 2, 2009

(65) Prior Publication Data

US 2010/0004062 A1 Jan. 7, 2010

Related U.S. Application Data

(60) Provisional application No. 61/130,878, filed on Jun. 3, 2008.

(51) Int. Cl.
*A63F 9/24* (2006.01)
*A63F 3/00* (2006.01)

(52) U.S. Cl.
CPC ..... *A63F 3/00643* (2013.01); *A63F 2003/00662* (2013.01); *A63F 2003/00668* (2013.01); *A63F 2009/242* (2013.01); *A63F 2009/247* (2013.01); *A63F 2009/2419* (2013.01); *A63F 2009/2467* (2013.01); *A63F 2009/2486* (2013.01);
(Continued)

(58) Field of Classification Search
USPC ..... 463/36
See application file for complete search history.

(56) References Cited

U.S. PATENT DOCUMENTS 3,843,132 A * 10/1974 Ferguson ..... 273/238
4,337,948 A * 7/1982 Breslow et al. ..... 273/237
4,348,191 A * 9/1982 Lipsitz et al. ..... 434/308
(Continued)

FOREIGN PATENT DOCUMENTS

DE 4039315 A1 12/1990
JP 538228 1/1978
(Continued)

OTHER PUBLICATIONS

Lopez De Ipina et al., "Trip: a Low-Cost Vision-Based Location System for Ubiquitous Computing", vol. 6, Issue 3, May 2002, pp. 206-219, Journal Personal and Ubiquitous Computing, and http://dl.acm.org/citation.cfm?id=594357.

*Primary Examiner* — Robert K Carpenter
(74) *Attorney, Agent, or Firm* — Haverstock & Owens LLP

(57) ABSTRACT

Apparatuses and methods for intelligent game systems for putting intelligence into board and tabletop games including miniatures are disclosed. An intelligent game system comprises one or more sensors, a controller, and a projector, the sensors each having an identifier. The sensors obtain object information from intelligent game piece objects and transfer the object information to a controller where it is associated with a sensor identifier and the sensor identifier is associated with a corresponding portion of an image. The controller interacts with the intelligent game piece objects, for managing game play, and for preparing and transferring a changing image to a projector. Intelligent game piece object features are disclosed, as well as methods of initializing a system for use with the intelligent game piece objects.

33 Claims, 22 Drawing Sheets

(52) U.S. Cl.
CPC ..... *A63F 2009/2489* (2013.01); *A63F 2300/1093* (2013.01)

(56) References Cited

U.S. PATENT DOCUMENTS 4,489,946 A 12/1984 Ortiz Burgos
4,492,581 A * 1/1985 Arai et al. ..... 434/128
4,515,371 A 5/1985 Basevi
4,527,800 A 7/1985 Samansky
4,534,565 A 8/1985 Hube
4,569,526 A 2/1986 Hamilton
4,666,160 A 5/1987 Hamilton
4,736,954 A 4/1988 Haney et al.
4,883,443 A 11/1989 Chase
4,964,249 A 10/1990 Payne
4,964,643 A 10/1990 Hass
4,969,650 A * 11/1990 Magara et al. ..... 273/238
4,981,300 A * 1/1991 Winkler ..... 273/238
5,013,047 A * 5/1991 Schwab ..... 273/238
5,082,286 A * 1/1992 Ryan et al. ..... 273/238
5,096,204 A 3/1992 Lippman
5,125,867 A 6/1992 Solomon
5,188,368 A * 2/1993 Ryan ..... 273/237
5,190,285 A * 3/1993 Levy et al. ..... 463/36
5,397,133 A * 3/1995 Penzias ..... 463/22
5,460,381 A * 10/1995 Smith et al. ..... 273/238
5,460,382 A * 10/1995 Loritz ..... 273/342
5,544,882 A 8/1996 Sarkar
5,662,508 A 9/1997 Smith
5,791,988 A * 8/1998 Nomi ..... 463/11
5,853,327 A * 12/1998 Gilboa ..... 463/39
5,864,346 A 1/1999 Yokoi et al.
5,906,369 A * 5/1999 Brennan et al. ..... 273/238
5,919,073 A 7/1999 Shinoda et al.
5,944,312 A 8/1999 Darneille
6,001,014 A 12/1999 Ogata et al.
6,009,458 A 12/1999 Hawkins et al.
6,012,961 A 1/2000 Sharpe, III et al.
6,036,188 A 3/2000 Gomez
6,102,397 A * 8/2000 Lee et al. ..... 273/238
6,167,353 A 12/2000 Piernot
6,203,017 B1 3/2001 Schultz
6,227,931 B1 * 5/2001 Shackelford ..... 446/268
6,276,685 B1 8/2001 Sterling
6,278,418 B1 8/2001 Doi
6,335,686 B1 1/2002 Goff et al.
6,443,796 B1 * 9/2002 Shackelford ..... 446/91
6,460,851 B1 * 10/2002 Lee et al. ..... 273/238
6,525,731 B1 2/2003 Suits et al.
6,526,375 B1 2/2003 Frankel et al.
6,545,682 B1 4/2003 Ventrella et al.
6,556,722 B1 4/2003 Russell et al.
6,581,822 B1 6/2003 Garran
6,682,392 B2 * 1/2004 Chan ..... 446/335
6,690,156 B1 2/2004 Weiner et al.
6,745,236 B1 6/2004 Hawkins et al.
6,761,634 B1 * 7/2004 Peterson et al. ..... 463/30
6,835,131 B1 * 12/2004 White et al. ..... 463/1
6,842,175 B1 1/2005 Schmalstieg et al.
6,937,152 B2 * 8/2005 Small ..... 340/568.1
7,008,316 B1 * 3/2006 Pugh ..... 463/10
7,050,754 B1 5/2006 Marcus
7,059,934 B2 6/2006 Whitehead
7,081,033 B1 * 7/2006 Mawle et al. ..... 446/175
7,204,428 B2 4/2007 Wilson
7,218,230 B2 5/2007 Wu et al.
7,397,464 B1 7/2008 Robbins
7,474,983 B2 * 1/2009 Mazalek et al. ..... 702/150
7,704,146 B2 4/2010 Ellis
7,766,335 B1 8/2010 Greenawalt
7,843,471 B2 * 11/2010 Doan et al. ..... 345/633
8,257,157 B2 9/2012 Polchin
8,303,369 B2 11/2012 Smith et al.
8,313,377 B2 11/2012 Zalewski
8,608,529 B2 12/2013 Smith et al.
8,690,631 B2 4/2014 Nag
8,753,164 B2 6/2014 Hansen et al.
9,329,469 B2 5/2016 Benko
2002/0036652 A1 3/2002 Masumoto
2002/0082065 A1 6/2002 Fogel
2002/0128068 A1 9/2002 Randall Whitten et al.
2002/0158751 A1 10/2002 Bormaster
2002/0167129 A1 11/2002 Stanton
2002/0193047 A1 12/2002 Weston
2002/0196250 A1 12/2002 Anderson et al.
2003/0034606 A1 2/2003 Jacobs
2003/0071127 A1 4/2003 Bryant et al.
2003/0119587 A1 6/2003 Ohba et al.
2003/0124954 A1 7/2003 Liu
2003/0141962 A1 7/2003 Barink
2003/0171142 A1 9/2003 Kaji et al.
2003/0232649 A1 12/2003 Gizis et al.
2004/0142751 A1 7/2004 Yamagami
2004/0189701 A1 9/2004 Badt, Jr.
2004/0203317 A1 10/2004 Small
2004/0224741 A1 11/2004 Jen et al.
2004/0248650 A1 * 12/2004 Colbert et al. ..... 463/37
2004/0259465 A1 * 12/2004 Wright et al. ..... 446/297
2005/0043089 A1 2/2005 Nguyen
2005/0059479 A1 3/2005 Soltys et al.
2005/0137004 A1 * 6/2005 Wood et al. ..... 463/11
2005/0149865 A1 7/2005 Wang et al.
2005/0245302 A1 11/2005 Bathiche et al.
2005/0247782 A1 11/2005 Ambartsoumian
2005/0277464 A1 12/2005 Whitten et al.
2006/0001933 A1 1/2006 Page
2006/0030410 A1 2/2006 Stenton
2006/0043674 A1 3/2006 Van Ness
2006/0061035 A1 3/2006 Collins
2006/0149495 A1 7/2006 Mazalek et al.
2006/0175753 A1 * 8/2006 MacIver et al. ..... 273/237
2006/0197669 A1 9/2006 Wu et al.
2006/0252554 A1 11/2006 Gururajan et al.
2006/0254369 A1 11/2006 Yoon et al.
2007/0015588 A1 * 1/2007 Matsumoto et al. ..... 463/43
2007/0057469 A1 * 3/2007 Grauzer et al. ..... 273/309
2007/0098234 A1 5/2007 Fiala
2007/0111795 A1 5/2007 Choi et al.
2007/0171199 A1 7/2007 Gosselin
2007/0216095 A1 9/2007 Jacobs
2007/0238530 A1 10/2007 Okada
2007/0262984 A1 11/2007 Pruss
2007/0275634 A1 * 11/2007 Wright et al. ..... 446/297
2007/0293289 A1 12/2007 Loeb
2008/0004093 A1 1/2008 Van Luchene et al.
2008/0020814 A1 1/2008 Kemene
2008/0045340 A1 2/2008 Kim
2008/0068173 A1 3/2008 Alexis et al.
2008/0085773 A1 4/2008 Wood
2008/0122805 A1 5/2008 Smith et al.
2008/0125217 A1 5/2008 Pavlovski
2008/0126533 A1 5/2008 Klein
2008/0131850 A1 6/2008 Danenberg
2008/0166926 A1 7/2008 Seymour et al.
2008/0172361 A1 7/2008 Wong et al.
2008/0180581 A1 7/2008 Slobodin
2008/0186174 A1 8/2008 Alexis et al.
2008/0192300 A1 8/2008 Kenji
2008/0220690 A1 9/2008 Munch
2008/0248847 A1 10/2008 Nakano et al.
2008/0267450 A1 10/2008 Sugimoto
2008/0280682 A1 11/2008 Brunner et al.
2008/0280684 A1 11/2008 McBride
2008/0315772 A1 12/2008 Knibbe
2009/0017908 A1 1/2009 Miyamoto
2009/0023487 A1 1/2009 Gilson et al.
2009/0044113 A1 2/2009 Jones et al.
2009/0069084 A1 3/2009 Reece et al.
2009/0082105 A1 3/2009 Hegstrom
2009/0089565 A1 4/2009 Buchanan et al.
2009/0104988 A1 4/2009 Enge et al.
2009/0075733 A1 5/2009 Anderson et al.
2009/0115133 A1 5/2009 Kelly et al.
2009/0117994 A1 5/2009 Kelly et al.

(56) References Cited

U.S. PATENT DOCUMENTS

| | | | |
|---|---|---|---|
| 2009/0137323 | A1 | 5/2009 | Fiegener et al. |
| 2009/0158210 | A1 | 6/2009 | Cheng et al. |
| 2009/0197658 | A1 | 8/2009 | Polchin |
| 2009/0227368 | A1 | 9/2009 | Wyatt |
| 2009/0315258 | A1* | 12/2009 | Wallace et al. ..... 273/238 |
| 2009/0325690 | A1 | 12/2009 | Zhou et al. |
| 2010/0001923 | A1 | 1/2010 | Zilber |
| 2010/0004062 | A1 | 1/2010 | Maharbiz et al. |
| 2010/0007798 | A1 | 1/2010 | Togawa |
| 2010/0032900 | A1 | 2/2010 | Wilm |
| 2010/0130280 | A1 | 5/2010 | Arezina |
| 2010/0141780 | A1 | 6/2010 | Tan |
| 2010/0151940 | A1 | 6/2010 | Borge |
| 2010/0164862 | A1 | 7/2010 | Sullivan et al. |
| 2010/0167623 | A1 | 7/2010 | Eyzaguirre et al. |
| 2010/0234094 | A1 | 9/2010 | Gagner |
| 2010/0247060 | A1 | 9/2010 | Gay |
| 2010/0253700 | A1 | 10/2010 | Bergeron |
| 2010/0291993 | A1 | 11/2010 | Gagner et al. |
| 2010/0311300 | A1 | 12/2010 | Hansen et al. |
| 2010/0331083 | A1 | 12/2010 | Maharbiz et al. |
| 2011/0015920 | A1 | 1/2011 | How |
| 2011/0074833 | A1 | 3/2011 | Murayama et al. |
| 2011/0089635 | A1 | 4/2011 | Miller |
| 2011/0111840 | A1 | 5/2011 | Gagner et al. |
| 2011/0159963 | A1 | 6/2011 | Link |
| 2011/0173587 | A1 | 7/2011 | Detwiller |
| 2011/0211175 | A1 | 9/2011 | Stehle |
| 2011/0250967 | A1 | 10/2011 | Kulas |
| 2011/0254832 | A1 | 10/2011 | Wilson et al. |
| 2011/0256927 | A1 | 10/2011 | Davis et al. |
| 2011/0269547 | A1 | 11/2011 | Harris |
| 2011/0312420 | A1 | 12/2011 | Portin |
| 2012/0032394 | A1 | 2/2012 | Levine |
| 2012/0038739 | A1 | 2/2012 | Welch et al. |
| 2012/0049448 | A1 | 3/2012 | Agamawi |
| 2012/0049453 | A1 | 3/2012 | Morichau-Beauchant et al. |
| 2012/0052931 | A1 | 3/2012 | Jaqua et al. |
| 2012/0052934 | A1 | 3/2012 | Maharbiz et al. |
| 2012/0056717 | A1 | 3/2012 | Maharbiz et al. |
| 2012/0157206 | A1 | 6/2012 | Crevin et al. |
| 2012/0295703 | A1 | 11/2012 | Reiche et al. |
| 2012/0295714 | A1 | 11/2012 | Reiche et al. |
| 2012/0320033 | A1 | 12/2012 | Papaefstahiou |
| 2013/0032999 | A1 | 2/2013 | Hildebrand |

FOREIGN PATENT DOCUMENTS

| | | | | |
|---|---|---|---|---|
| JP | 08103534 | A | * | 4/1996 |
| JP | 2001228963 | A | | 8/2001 |
| JP | 2002135258 | A | | 5/2002 |
| JP | 2002156896 | A | | 5/2002 |
| JP | 2003117245 | A | | 4/2003 |
| JP | 2003230761 | A | | 8/2003 |
| JP | 2005-317032 | | | 11/2005 |
| JP | 2006142065 | | | 6/2006 |
| JP | 2008-501490 | | | 1/2008 |
| JP | 200877411 | A | | 4/2008 |
| JP | 2008528119 | A | | 7/2008 |
| WO | 9931569 | A1 | | 6/1999 |
| WO | 02010791 | A2 | | 2/2002 |
| WO | 2005078562 | A1 | | 8/2005 |
| WO | 2006033036 | A2 | | 3/2006 |
| WO | WO 2006033036 | A2 | * | 3/2006 |
| WO | 2006136322 | A2 | | 12/2006 |
| WO | 2007017848 | A2 | | 2/2007 |
| WO | 2007104693 | A1 | | 9/2007 |
| WO | WO2012028827 | A1 | | 3/2012 |

* cited by examiner

| Register | Mnemonic | Description | Example value |
|---|---|---|---|
| 0 | UID-H | Unique identifier - high word | 0x0000..0xFFFF |
| 1 | UID-L | Unique identifier - low word | 0x0000..0xFFFF |
| 2 | ADDR | Sensor identifier | 0x0000..0xFFFF |
| ... | | | |
| 10 | LName | Long name (up to 30 characters) | "Zoltar" |
| ... | ... | ... | |
| 25 | Class | Class of character (e.g. Profession) | 1=Warrior |
| 26 | Race | Fictional race identifier | 2=Morlok |
| 27 | Stamina | Rate of recharge, points/min. | 5 |
| 28 | Experience | Experience points | 5,000 |
| 29 | Level | Power level 1..5, 5=highest | 2 |
| 30 | Hitpoints | Hitpoints (0=dead) | 0x0000...0xFFFF |
| 31 | WeaponCount | Count of weapons | 3 |
| 32 | WeaponID-1 | Weapon 1 identifier | 1=Sword |
| 33 | WeaponWT-1 | Weapon 1 weight, lbs. | 8 |
| ... | | | ... |
| 43 | Armor Count | Count of Armor | 2 |
| 44 | ArmorID-1 | Armor 1 identifier | 1=Shield |
| 45 | ArmorStrength-1 | Strength of armor (0..100) | 60 |
| ... | | | |
| 53 | AcessoryCount | Count of accessories | 1 |
| 54 | AccessoryID-1 | Accessory identifier | 1=Weapons belt |
| ... | | | |
| 127 | CKSUM | Checksum value (integrity check) | |

Fig. 7A

| Register | Mnemonic | Description | Example value |
|---|---|---|---|
| 0 | UID-H | Unique identifier - high word | 0x0000..0xFFFF |
| 1 | UID-L | Unique identifier - low word | 0x0000..0xFFFF |
| 2 | ADDR | Sensor identifier | 0x0000..0xFFFF |
| ... | | | |
| 10 | LName | Long name (up to 30 characters) | "Pawn" |
| ... | ... | ... | |
| 25 | Class | Class of chess piece | 0=Pawn |
| 26 | Player | Player side color: Black/White | 0=White, 1=Black |
| ... | | | |
| 127 | CKSUM | Checksum value (integrity check) | |

Fig. 7B

| Register | Mnemonic | Description | Example value |
|---|---|---|---|
| 0 | UID-H | Unique identifier - high word | 0x0000..0xFFFF |
| 1 | UID-L | Unique identifier - low word | 0x0000..0xFFFF |
| 2 | ADDR | Sensor identifier | 0x0000..0xFFFF |
| ... | | | |
| 10 | LName | Long name (up to 30 characters) | "King" |
| ... | ... | ... | |
| 25 | Class | Class of chess piece | 5=King |
| 26 | Player | Player side color: Black/White | 0=White, 1=Black |
| ... | | | |
| 127 | CKSUM | Checksum value (integrity check) | |

Fig. 7C

| Register | Mnemonic | Description | Example value |
|---|---|---|---|
| 0 | UID-H | Unique identifier - high word | 0x0000..0xFFFF |
| 1 | UID-L | Unique identifier - low word | 0x0000..0xFFFF |
| 2 | ADDR | Sensor identifier | 0x0000..0xFFFF |
| ... | | | |
| 10 | LName | Long name (up to 30 characters) | "Shoe" |
| ... | ... | ... | |
| 25 | Class | Class of Monopoly piece | 1=Token |
| 26 | Player | Player having this piece | 2=Player 2 |
| 27 | Value-H | Amount of money assoc. w/token | 0x0000-0xFFFF |
| 28 | Value-L | | 0x0000-0xFFFF |
| ... | | | |
| 127 | CKSUM | Checksum value (integrity check) | |

Fig. 7D

| Register | Mnemonic | Description | Example value |
|---|---|---|---|
| 0 | UID-H | Unique identifier - high word | 0x0000..0xFFFF |
| 1 | UID-L | Unique identifier - low word | 0x0000..0xFFFF |
| 2 | ADDR | Sensor identifier | 0x0000..0xFFFF |
| ... | | | |
| 10 | LName | Long name (up to 30 characters) | "Hotel" |
| ... | ... | ... | |
| 25 | Class | Class of Monopoly piece | 2=Hotel |
| 26 | Player | Player having this piece | 2=Player 2 |
| 27 | Value-H | Rent value associated w/ hotel | 0x0000-0xFFFF |
| 28 | Value-L | | 0x0000-0xFFFF |
| ... | | | |
| 127 | CKSUM | Checksum value (integrity check) | |

Fig. 7E

INTELLIGENT GAME SYSTEM FOR PUTTING INTELLIGENCE INTO BOARD AND TABLETOP GAMES INCLUDING MINIATURES

CROSS-REFERENCE TO RELATED APPLICATIONS

This application claims the benefit of U.S. Provisional Patent Application Ser. No. 61/130,878, filed Jun. 3, 2008 and entitled "PUTTING INTELLIGENCE INTO MINIATURES GAMES", which is hereby incorporated by reference in its entirety for all purposes.

FIELD OF THE INVENTION

The present invention relates to the field of board and tabletop games including miniatures. More specifically, the present invention relates to intelligent game systems for putting intelligence into board and tabletop games including miniatures.

BACKGROUND OF THE INVENTION

Miniatures games are typically played on a board or tabletop on which players control dozens to hundreds of individual miniature figures (usually ranging from ½" to 10"+ in base diameter) in some form of tactical combat simulation. The detail of the tabletop environment, the intricacy of the miniatures and the complexity of the tactical game vary widely between the different games currently available.

All of these games have historically used dice to determine combat outcomes and pen and paper to record the progress, such as how wounded a particular figure is. The emergence of large online worlds like World of Warcraft and Everquest, with complex simulation-level physics and realism, has generated a steady pressure to make these games more sophisticated. However, this has been largely limited by players' reluctance to have to do lots of math on paper. In other words, there is no good way to reproduce the complexity of the combat of online worlds without ruining the feel of tabletop games. One manufacturer, WizKids, Inc., has developed a new type of miniature that has a "decoder-ring"-like base which is moved as the figure becomes wounded. Thus, each miniature keeps track of its own damage, movement, and other game piece information with a simple mechanical system. A window on the base shows the figure's current status and rotating the wheel changes the status as the game progresses. Although the base tracks many items of information, the information is only available as a physical state of the rotational base. Further, updating of the status of the figure is manual, as is scoring. The greater the number of players or game pieces, the more difficult it is to update player status information and scoring. But, game play, particularly for historical re-enactment games is more robust and realistic with a higher number of game pieces. Thus, the very aspect that makes miniatures games exciting to play—diverse and numerous pieces—limits the enjoyment of the game by requiring detailed updates of individual game piece information and scoring.

Enjoyment of traditional table top board games, such as Monopoly® and Sorry®, is similarly affected by extensive record keeping and scoring due to lack of computer awareness of game pieces. For example, in Monopoly®, the value of rent charged to a player who lands on a property depends upon the number of house or hotels on the property and the initial value of the property. The count of cash in the community chest similarly may need to be counted. For a player to make game play decisions, the player often must know the value of their total assets including mortgage value of their properties and available rents, and the value of their cash.

The recent decline in prices of projectors, such as digital light processors (DLP® Texas Instruments), LCD projectors, and flat panel displays, coupled with the need to simplify and facilitate the logistic portion of game play has sparked interest in increasing the interactivity of game play through computer-enhanced graphics and sound. However, the existing miniatures cannot interact with computer graphics for the same reason that a computer game cannot capture the player's information to facilitate scoring and game play. There is no computer-awareness of the miniatures.

SUMMARY OF THE INVENTION

An intelligent game system for putting intelligence into board and tabletop games including miniatures comprises one or more sensors, configured to obtain object information from an object, each sensor corresponding to a portion of an image. In some embodiments, each sensor has an address. Existing game piece miniatures are able to be combined with objects having object information readable by a sensor in one or more sensors to generate intelligent game piece objects. In an intelligent game system, the sensors further comprise a power source coupled to intelligent game piece objects are able to implement additional features in the intelligent game system and intelligent game piece objects. A controller is configured to receive the object information and to associate the object information with a sensor. A controller with a computer readable media, configured to be read by the controller and programmed with instructions for implementing a game, processes the object information along with the instructions for implementing the game and produces an updated, changing image for transmission to an image projector. The image projector then projects the updated, changing image onto the surface of the sensors.

In another aspect, the projected image is able to be a static background image of a board game such as checkers, chess, Monopoly® or Sorry®, for example. Intelligent game piece object information is able to be collected using the sensors and then transferred to the controller. The controller then updates the scoring information and game logic for display on the controller. In embodiments of the intelligent game system where the controller has no display, the image projector is able to be used to project an updated, changing image onto the surface of the sensors.

Another aspect of the intelligent game system for putting intelligence into board and tabletop games including miniatures comprises adding sound and graphics to the game. Sound and graphics are able to be used to enhance the depiction of interaction between intelligent game piece objects or to accentuate any interaction between the user, player(s) and the game operation. Graphics are able to be projected onto the surface of the sensors where the intelligent game piece objects are located. Static backgrounds, such as terrains of a civil war battle, or dynamic graphics and sound, such as a flash from a canon barrel and the associated boom sound from the speakers, are able to be coordinated with the intelligent game piece objects.

In another aspect, an intelligent game system for putting intelligence into board and tabletop games including miniatures is able to comprise a variety of input devices including keyboard, touch-screen panel and auxiliary switches.

Additional aspects of the system comprise additional output devices, audio devices and display devices.

In yet another aspect, the intelligent game piece objects have enhanced features such as lighting, audio processing, nonvolatile memory or a rotating base.

In one aspect, an intelligent game system comprises one or more sensor modules to obtain object information from an object, each sensor module associated with a portion of an image, and a controller coupled to receive the object information and to associate the object information with a portion of an image. In some embodiments, the intelligent game system comprises interface electronics coupled to receive the object information from each sensor module, and the controller is coupled to the interface electronics to receive the object information. In some embodiments, an intelligent game system further comprises a computer readable media, programmed with instructions for implementing a game, and configured to be read by the controller. The object information read by each sensor is able to be an identifier of the object, and in some embodiments the identifier is a unique identifier. In some embodiments, an intelligent game system further comprises a projector coupled to receive image information from the controller. In some embodiments, the controller processes the object information and the sensor address of each sensor module to update a changing image, and the controller transmits the image information to the projector. In some embodiments, the sensors are identified by names, or time slots, or mapped to input ports of a controller. In some embodiments, each of the sensor modules comprise a radio frequency identification (RFID) reader and the unique identifier comprises an RFID. In some embodiments, each of the sensor modules comprise a bar code reader and the unique identifier comprises a bar code. In further embodiments, the sensor modules comprise one or more of detectors such as an opto-detector, a Hall-effect sensor, a switch, or a circuit made or broken. In some embodiments, the object information comprises a property of an object at the sensor. Each sensor module is further able to comprise a plurality of electrical supply points. Some embodiments further comprise a payment interface for receiving payment for use of the intelligent game system. Additional embodiments comprise sound reproduction equipment. In such embodiments, the controller transmits audio to the sound reproduction equipment. In some embodiments, an intelligent game system further comprises a communications device operably coupled to the controller for communicating with one or more remote game systems.

In another aspect, a game piece comprises object information capable of being read by a sensor on an intelligent game system. The object information is able to be an identifier of the object, and in some embodiments the identifier is a unique identifier. In some embodiments, the unique identifier is a RFID tag or a bar code. In some embodiments, a game piece further comprises a power source. In powered embodiments, a game piece is able to further comprise a a light emitting source and light transmission equipment, and is further able to comprise an audio processor and audio distribution equipment.

In another aspect, a method of updating image information and projecting a changing image using one or more sensors to obtain object information from one or more movable objects comprises reading the object information from each sensor of one or more sensors, wherein each sensor corresponds to a portion of an image. The method further comprises associating the object information with a portion of an image, performing application specific processing using the object information, updating image information, and transmitting image information to a projector. In some embodiments, the reading the object information from a sensor in the one or more sensors is conditioned on the presence of an object at the sensor. In some embodiments, the object is a game piece and the information is a unique identifier, such as an RFID.

In a further aspect, a method of obtaining object information using one or more sensors, each sensor in the one or more sensors having a state indicating the presence of an object, the method comprises for each sensor in the one or more sensors reading the sensor state from the sensor. If the sensor state reading indicates the presence of an object, then initiating a transmission of the object's object information to a receiver, the receiver receiving the object information. In some embodiments, the steps of initiating transfer of the object's object information to a receiver and the receiver receiving the object information are executed only when the sensor state changes to indicate the presence of an object.

In another aspect, a method of playing an intelligent game comprises initializing intelligent game system components and software, associating one or more first objects with a first player, placing one or more of the first objects onto a surface comprising one or more sensors, and each sensor in the one or more sensors corresponds to a portion of an image. The method further comprises obtaining object information for the first objects using the one or more sensors, for each of the first objects placed onto the surface, processing the object information for at least one first object using an application software, updating a changing image, transmitting image information to an image projector, and storing the game state information, if the game is terminated, and the game is to be resumed later. In some embodiments, the method further comprises associating one or more second objects with a second player, associating the second object with object information and associating the second object information with a portion of an image, for each second object, and processing the object information for at least one second object using an application software. In some embodiments, the one or more second objects are able to comprise a one or more virtual second objects.

In another aspect, an intelligent game system comprises one or more sensor modules to obtain object information from an object, each sensor module corresponding to a portion of an image, interface electronics coupled to receive the object information from each sensor module, and a controller coupled to receive the object information of each sensor module from the interface electronics, and to associate the object information with a portion of an image. An intelligent game system further comprises a computer readable media, programmed with instructions for implementing a game and configured to be read by the controller, a projector, coupled to receive image information from the controller, wherein the projector receives image information from the controller and projects an image onto the surface of the one or more sensors based on the image information received from the controller, and a game piece comprising object information capable of being read by a sensor module in the one or more sensor modules, wherein the object information is an identifier.

BRIEF DESCRIPTION OF THE DRAWINGS

FIG. 7A illustrates a memory map of nonvolatile memory within an intelligence game piece object for a combat game.

FIGS. 7B and 7C illustrate a memory map of nonvolatile memory within an intelligence game piece object for a chess game.

FIGS. 7D and 7E illustrate a memory map of nonvolatile memory within an intelligence game piece object for a Monopoly® game.

DETAILED DESCRIPTION OF THE DRAWINGS

A system for putting intelligence into board and tabletop games including miniatures comprises one or more sensors to read object information from an object. In some embodiments, each sensor has an address. In some embodiments, the sensors are identified by names, or time slots, or are mapped to input ports of a controller. Interface electronics receive the object information from each sensor, a controller receives the object information and the sensor address for each sensor, and associates the object information with the sensor address. In some embodiments, the controller associates the object information with a portion of an image. A computer readable media is programmed with instructions for implementing a game, and is read by the controller. The system further comprises a projector which receives image information from the controller, and projects the image information. The controller processes the object information to update a changing image, and to transmit image information to the projector. In some embodiments, the system further comprises an object having object information. In some embodiments, the system further comprises speakers, and a removable computer readable media. The removable computer readable media is able to be any appropriate memory device, such as a flash memory stick, SIMM memory card, a compact disk, a magnetic disk, digital video disk, or a game cartridge.

Intelligent Game System

Figure 1A:
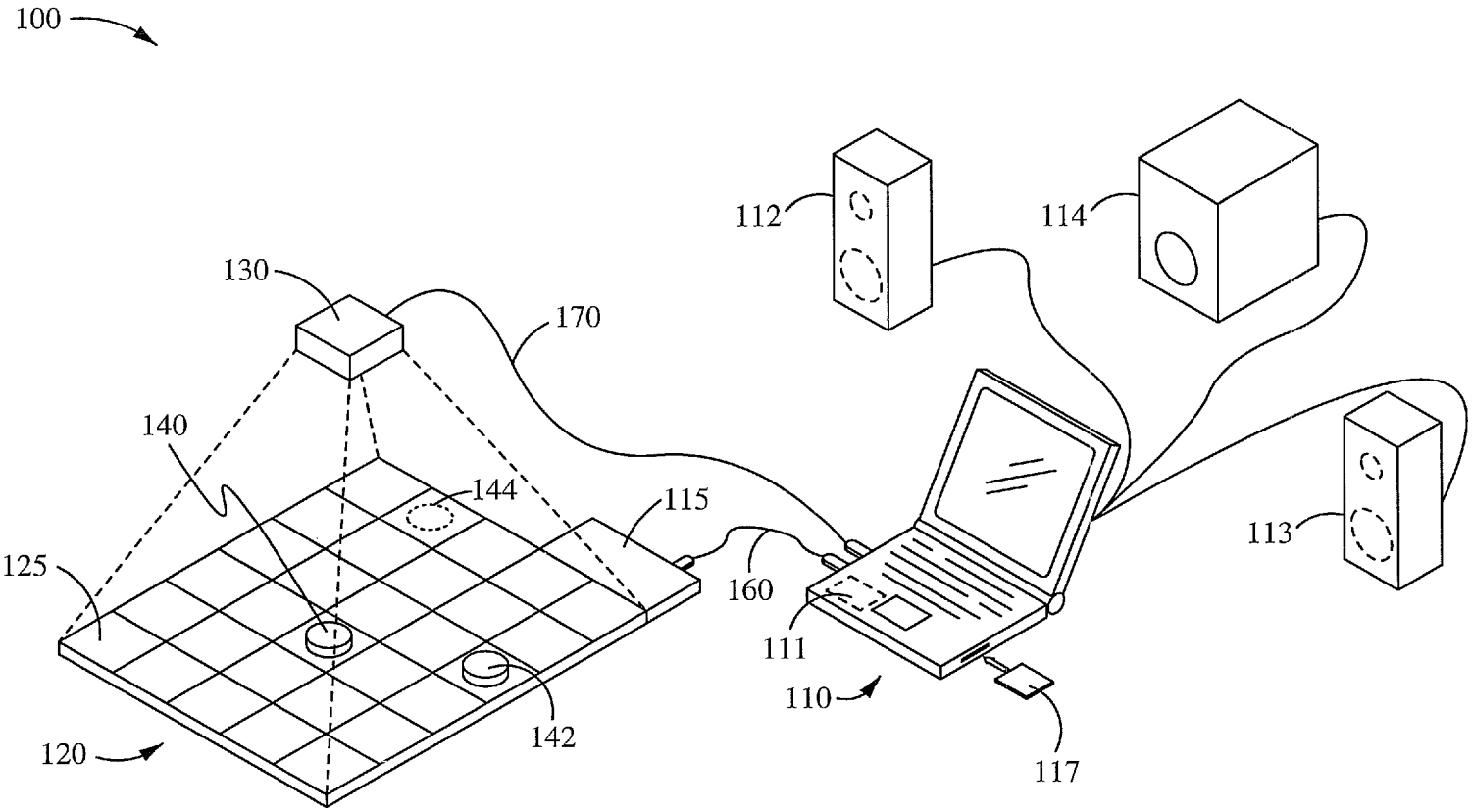
FIG. 1A illustrates a diagram of an intelligent game system for putting intelligence into board and tabletop games including miniatures according to some embodiments.

FIG. 1A illustrates a system for putting intelligence into board and tabletop games including miniatures 100 comprising one or more sensors 120, interface electronics 115, a controller 110, a computer readable media 111, a removable computer readable media 117, a projector 130, speakers 112, 113, and 114, interconnection cables 160 and 170, intelligent games piece objects 140 and 142, and a virtual game piece object 144 according to some embodiments. As the embodiment is explained, below, it will be clear to one skilled in the art that any number and type of intelligent game piece objects are able to be used, depending upon such variables as the actual game being played and the number of game players.

The sensors 120 comprise one or more sensors such as sensor 125. In some embodiments, each sensor 125 comprises a single type of sensor. In some embodiments, each sensor 125 comprises a plurality of different sensor types. Although all of the illustrations, FIG. 1A through 1F, show the sensors 120 organized as a rectangular array of sensors 125, the sensors 125 are able to be arranged in any physical arrangement. The identifier of each sensor 125 in the one or more sensors 120 is decoded within the interface electronics 115. Each sensor corresponds to a portion of an image to be projected by the projector 130. The interface electronics 115 are coupled to the controller 110 via the sensor interface cable 160. The interface electronics 115 create a high level interface between the sensors 120 and the controller 110. The interface electronics 115 manage the sensors 125 such that any object information related to the intelligent game piece objects, 140 and 142, sensed by a sensor 125, is transmitted to the controller 110 via the sensor interface cable 160. In some embodiments, the sensor interconnect cable 160 is an industry-standard USB cable utilizing communications messages which conform to any of the applicable standards such as USB 1.1, 2.0 or the emerging USB 3.0.

In some embodiments, the controller 110 is any commercially available personal computer. In some embodiments, the controller is able to be a single board computer, a personal computer, a networked computer, a cell phone, a personal digital assistant, a gaming console, a portable electronic entertainment device or a portable electronic gaming device. The controller 110 contains a computer readable media 111 programmed with instructions to respond to changes in the object information of an object 140, sensed by a sensor 125 within the one or more sensors 120. In some embodiments, game state information is able to be transferred to intelligent game piece objects 600 as object information. One skilled in the art will recognize that programmed instructions comprise a software application which contains the logic, game rules, scoring, sound, graphics, and other attributes of game play for playing an interactive game with intelligence as disclosed herein. The application software processes the object information received from the interface electronics 115 and transmits image information of a changing image to the projector 130. In some embodiments, the intelligent game piece objects 600 transmit their object information to the controller 110 via a wireless router 150 or directly to the controller 110 equipped with a wireless interface 116.

In some embodiments, the projector 130 projects an image onto the entire surface area of the sensors 120. In some embodiments, the projector 130 projects an image representing an object 140, along with other game images, onto any surface. In some embodiments, the projector further projects an image of one or more virtual game piece objects 144. In some embodiments, the projector 130 projects the image onto a portion of the surface area of the sensors 120. In some embodiments, the projector 130 is a DLP® (Texas Instruments) projector. In other embodiments, the projector 130 is any projection device capable of receiving image information and projecting an image onto the surface area of the sensors 120, such as any of the commercially available LCD projectors. The application software further provides sound via the speakers 112, 113, and 114 which are coupled to the controller 110. As described further below, in some embodiments the controller 110 is able to communicate directly, or indirectly, with the intelligent game piece objects 600 to implement the functionality within the intelligent game piece objects 600. In some embodiments, game state information is able to be stored on the removable computer readable media 117 or on the computer readable media 111 within the controller 110, thereby enabling resumption of a game in progress at a later date on the same intelligent game system or on a different intelligent game system. One skilled in the art would recognize that such game state information is able to be conveyed to other intelligent game systems 100 by, for example, transfer via the internet through email, or by uncoupling and transporting the controller 110 to another location for coupling to another intelligent game system 100. In the case of powered intelligent game piece objects 600, game state information may further be stored within the powered intelligent game piece objects 600.

Figure 1B:
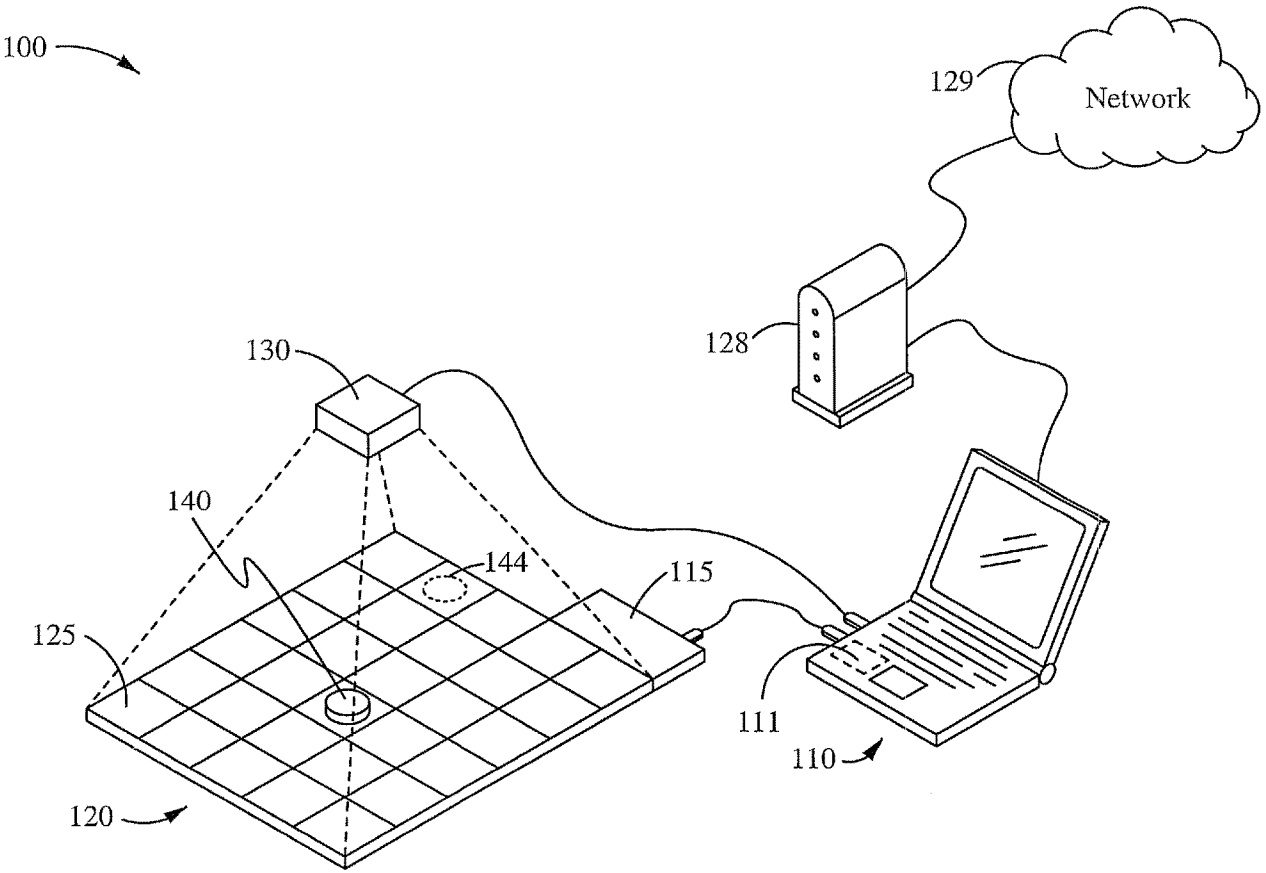
FIG. 1B illustrates a diagram of an intelligent game system for putting intelligence into board and tabletop games including miniatures according to some embodiments.

FIG. 1B illustrates a diagram of a system for putting intelligence into board and tabletop games including miniatures supporting remote play of an intelligent game system according to some embodiments. A network access device 128, such as a cable modem or DSL modem, is operably coupled to the controller 110 and to a network 129. Remote player game pieces are able to appear as virtual game piece objects 144, projected onto the surface area of the sensors 120.

Figure 1C:
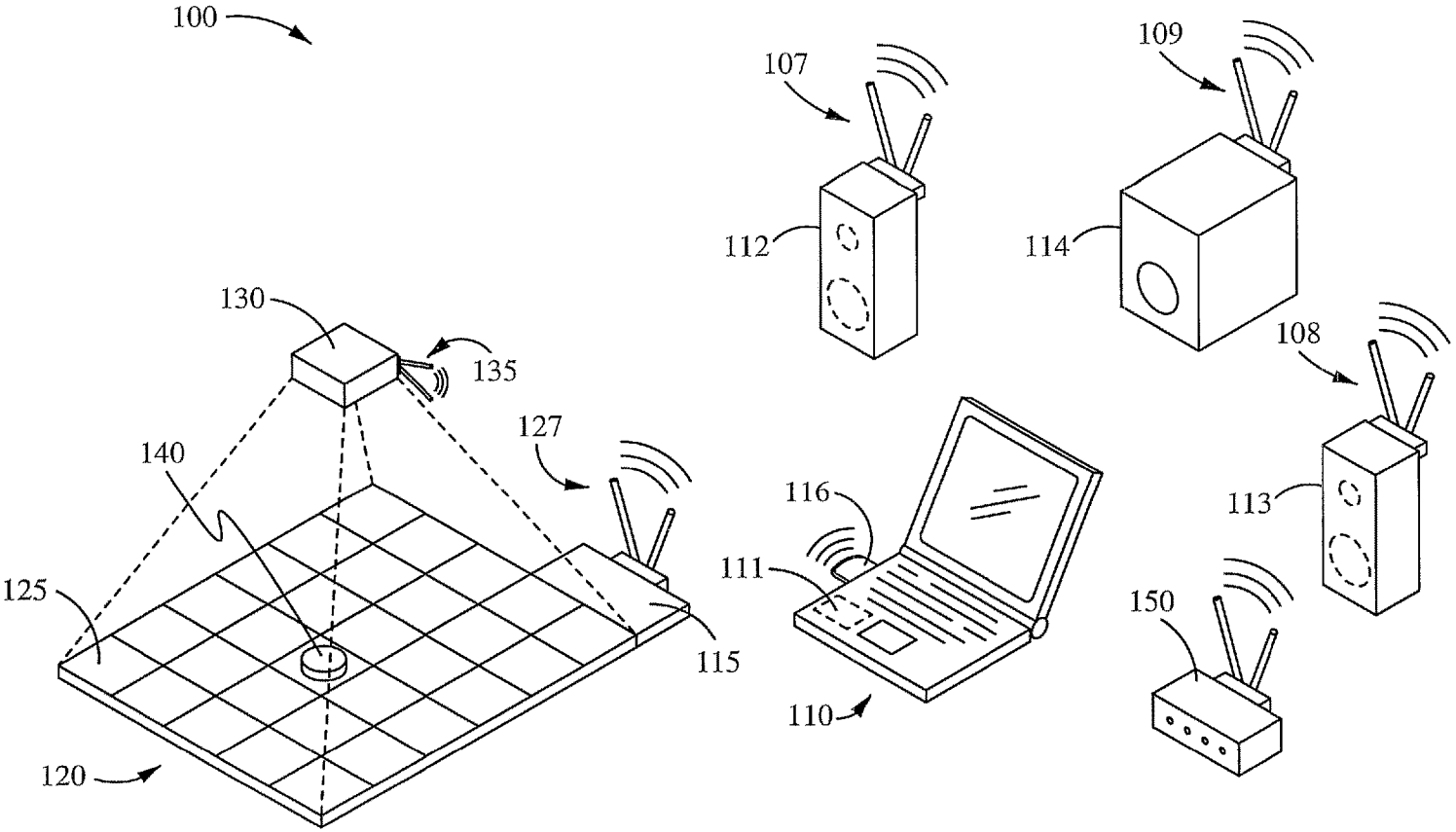
FIG. 1C illustrates a diagram of an intelligent game system for putting intelligence into board and tabletop games including miniatures according to some embodiments.

FIG. 1C illustrates a diagram of a system for putting intelligence into board and tabletop games including miniatures supporting wireless interconnection of system elements according to some embodiments. The sensors 120 with interface electronics 115 further comprise a wireless adapter 127. The speakers 112, 113, and 114 further comprise wireless adapters 107, 108 and 109 respectively. The controller 110 further comprises a wireless adapter 116 for receiving object information from the sensors 120 and for transmitting image information of a changing image to the projector 130 having a wireless adapter 135. Each wireless adapter 107, 108, 109, 116, 127, and 135 is further able to communicate via a wireless router 150. In some embodiments, the controller 110 is able to transmit sound information to speakers 112 through 114 via one or more wireless adapters.

Figure 1D:
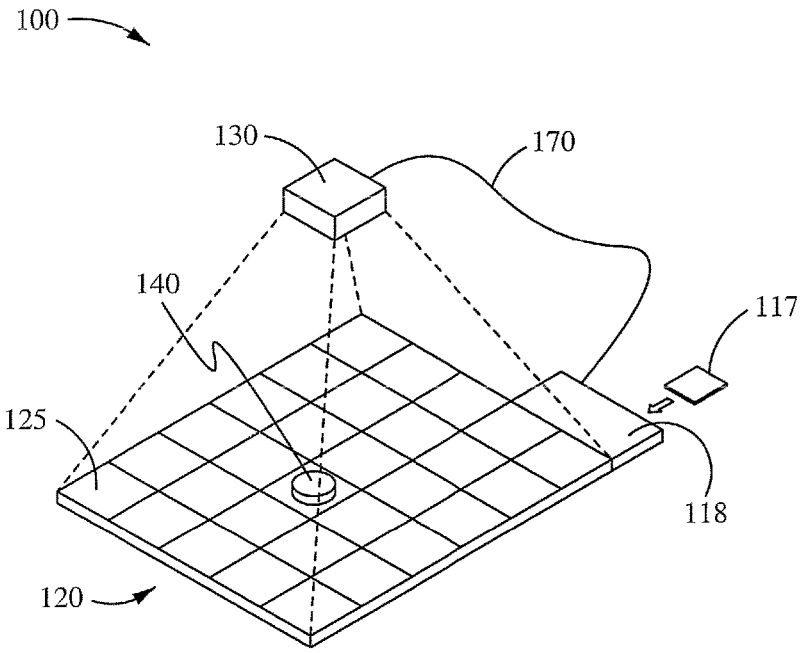
FIG. 1D illustrates a diagram of an intelligent game system for putting intelligence into board and tabletop games including miniatures according to some embodiments.

FIG. 1D illustrates a diagram of a system for putting intelligence into board and tabletop games including miniatures wherein the controller and the interface electronics are merged onto a single controller 118 according to some embodiments. The single controller 118 is able to be physically integrated with the sensors 120 or is able to be physically separate from the sensors 120. The interface controller 118 is able to further comprise a removable computer readable media 117 such as a SIMM card or a USB memory stick, game cartridge, magnetic disk, digital video disk, compact disk or other portable removable media. In these embodiments, the interface controller 118 receives object information from the sensors 120 via its own interface electronics. The game application software is able to be resident on the computer readable media 111 within the controller 118, or on a removable computer readable media 117. The game application software processes the object information received from the sensors 120 and transmits the image information of a changing image to the projector 130.

Figure 1E:
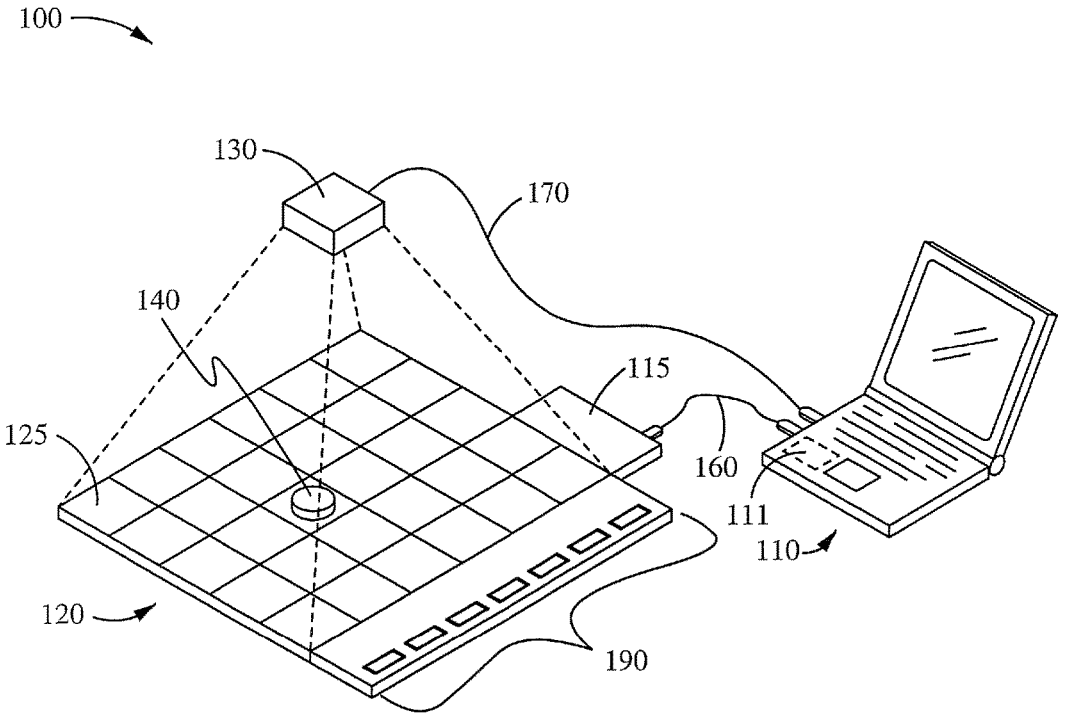
FIG. 1E illustrates a diagram of an intelligent game system for putting intelligence into board and tabletop games including miniatures according to some embodiments.

FIG. 1E illustrates a diagram of a system for putting intelligence into board and tabletop games including miniatures comprising one or more switches or buttons 190 according to some embodiments. The switches or buttons 190 are able to include dedicated functionality, such as a "Start" or "Reset" button, and switches or buttons 190 are further able to include programmable functionality such as programmable function keys F1 through F4. One skilled in the art will recognize that the switches or buttons are able to be implemented in a variety of technologies such as mechanical switches, capacitive switches, membrane switches, and the like. The switches or buttons 190 are able to be physically a part of the structure of the sensors 120 or the switches or buttons 190 are able to be a separate physical structure from the sensors 120. The switches or buttons 190 are interfaced to the interface electronics 115 and received by the controller 110 via the sensors interface cable 160.

Figure 1F:
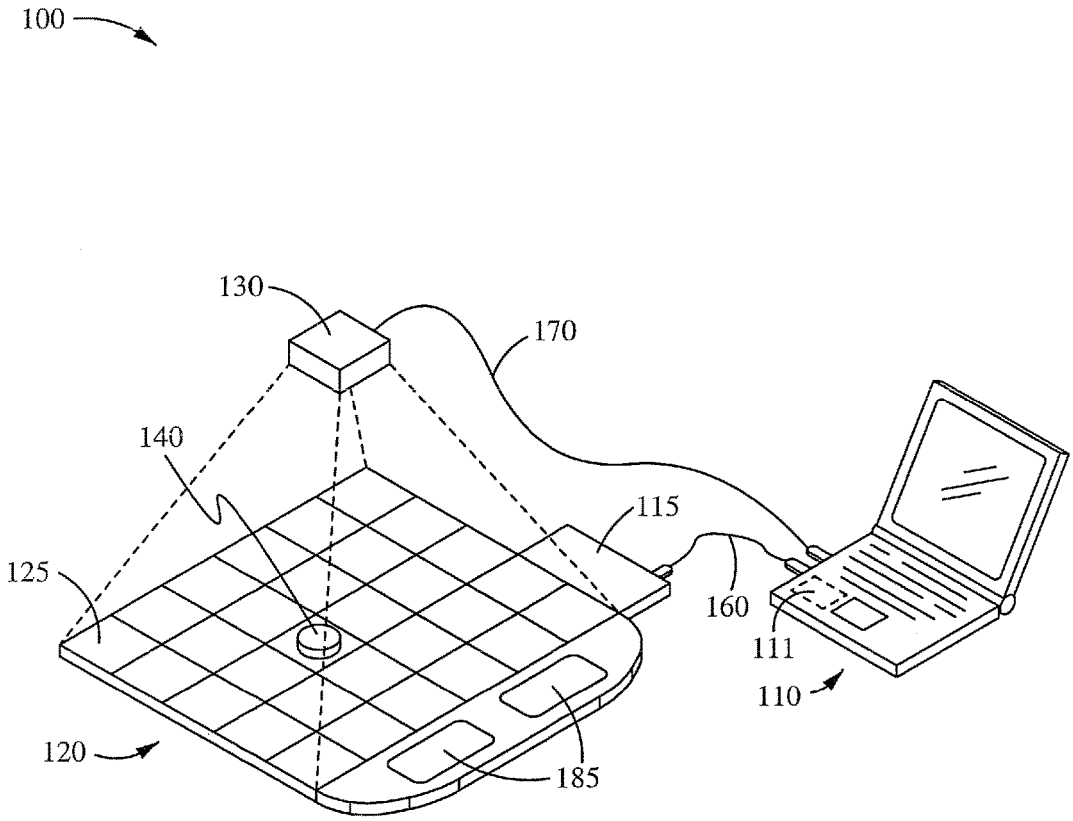
FIG. 1F illustrates a diagram of an intelligent game system for putting intelligence into board and tabletop games including miniatures according to some embodiments.

FIG. 1F illustrates a diagram of a system for putting intelligence into board and tabletop games including miniatures comprising one or more touch screens 185 according to some embodiments. Touch screens 185 are able to be physically a part of the structure of the sensors 120 or a separate physical structure from the sensors 120. The controller 110 transmits information to a touch screen 185, and receives information from a touch screen 185, via the electronics interface 115.

Figure 1G:
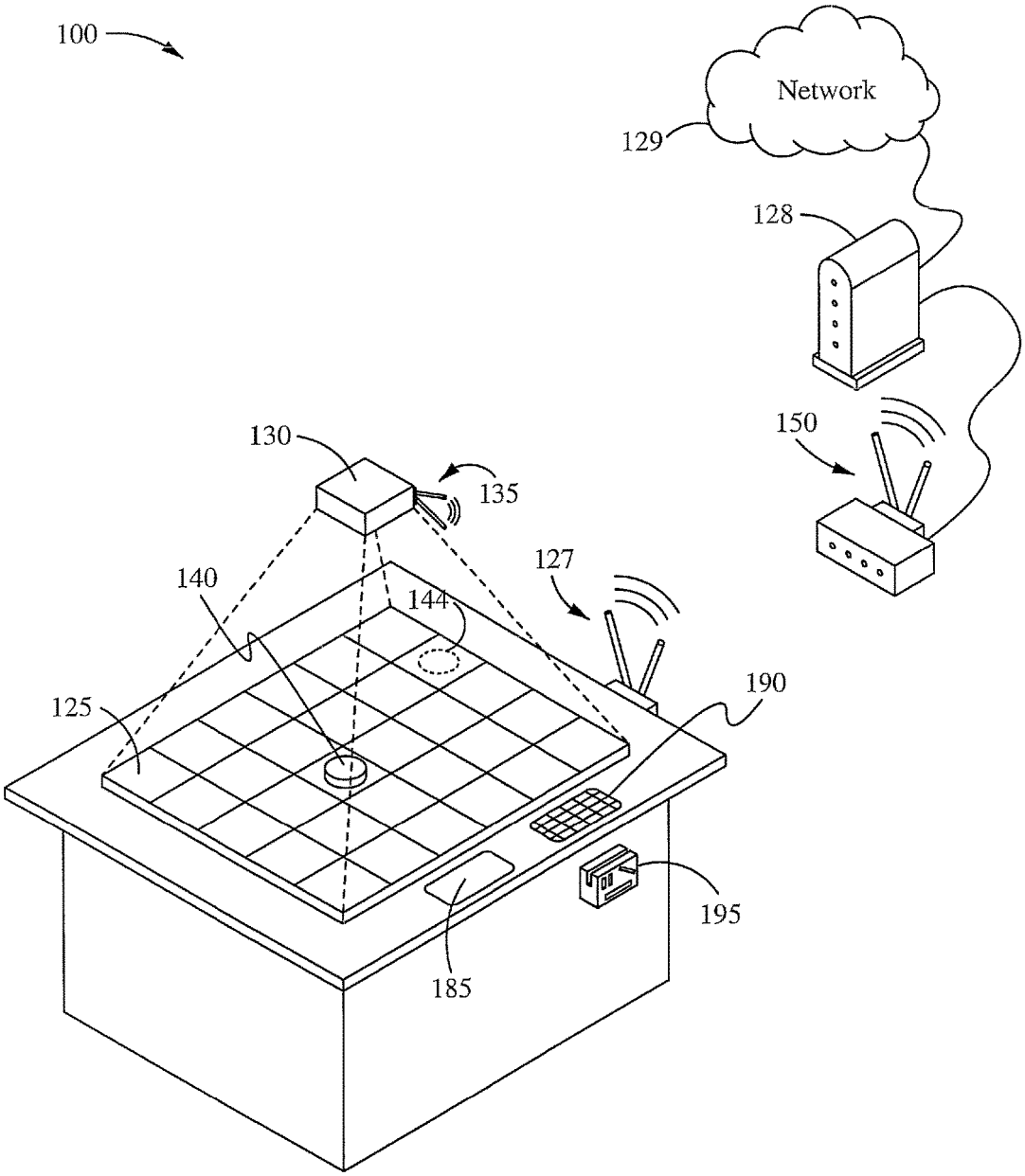
FIG. 1G illustrates a diagram of an intelligent game system for putting intelligence into board and tabletop games including miniatures according to some embodiments, configured for use in amusement or arcade environments.

FIG. 1G illustrates a diagram of a system for putting intelligence into board and tabletop games including miniatures comprising a payment system 195 according to some embodiments. FIG. 1G is exemplary of an arcade or amusement configuration. Payment system 195 comprises a magnetic swipe card slot, a cash reader/scanner, token accepting slots and a return button. One skilled in the art will recognize that any combination of the listed payment methods may be available commercially as an add-on module to the intelligent game system. Additional switches or buttons 190 are able to be used to check login credentials by logging on to a remote system to enable payment by an account or with micro-cash. Touch screen 185 may be used to display login keystrokes. In addition, touch screen 185 is able to be used as a login input device instead of additional switches or buttons 190. In some embodiments, system components are coupled via wireless communications devices 135 (projector), 150 (router) and 127 (sensors and controller). Wireless router 150 is able to be further coupled to a DSL or cable modem 128 and further coupled to a network 129, such as the Internet, enabling electronic payment features and remote game play.

Figure 2A:
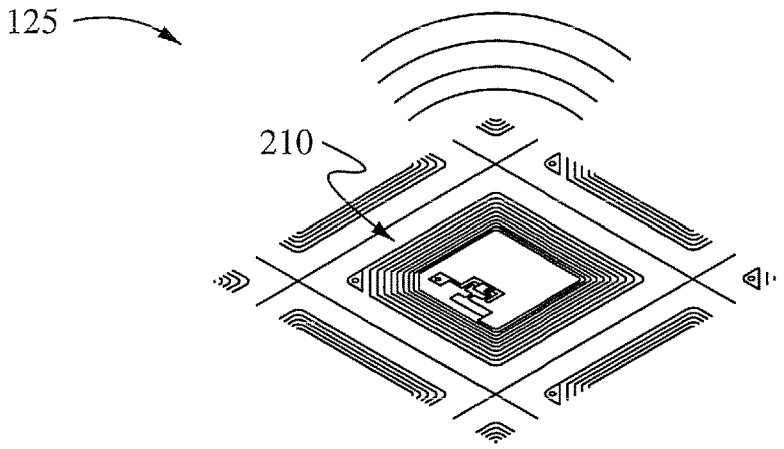
FIG. 2A illustrates a diagram of a RFID reader as a sensor in the one or more sensors according to some embodiments.
Figure 2B:
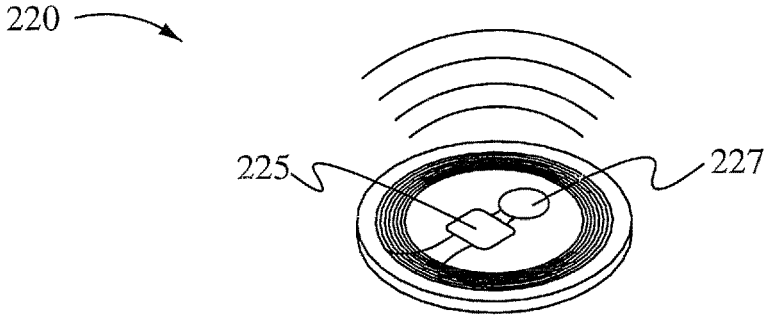
FIG. 2B illustrates a diagram of an object containing an active RFID tag according to some embodiments.
Figure 2C:
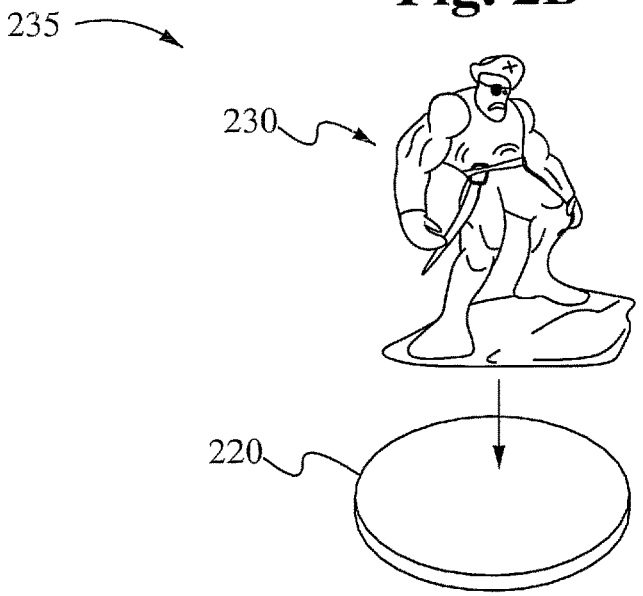
FIG. 2C illustrates a diagram of an existing game piece mounted on an object containing an RFID tag according to some embodiments.

FIG. 2A illustrates a sensor 125 according to some embodiments. The sensor comprises a RFID reader 210 with associated antenna. In some embodiments, low voltage electrical power is available within the sensors 120. FIG. 2B illustrates an object 220 according to some embodiments comprising an inexpensive, commercially available RFID tag 225 wherein the tag is passive. In some embodiments, the RFID tag 225 is an active tag, and optional battery 227 is included in the object 220. In some embodiments, an active RFID tag comprises, for example, an Atmel® Asset Identification EEPROM part number AT24RF08C. The Atmel part has 1K bytes of on-board EEPROM, a nonvolatile memory, with which to store object information in addition to the RFID tag. FIG. 2C illustrates affixing the object 220 to an existing game piece miniature 230 to create an intelligent game piece object 235. The object 220 is lightweight, and thus any readily available adhesive, such as Elmer's Glue™, two-sided tape, rubber cement, model glue, or epoxy, will serve to affix the object 220 to the existing game piece miniature 230. It will be clear to one of skill in the art that the RFID tag is also able to be mechanically coupled to the existing game piece.

Figure 2D:
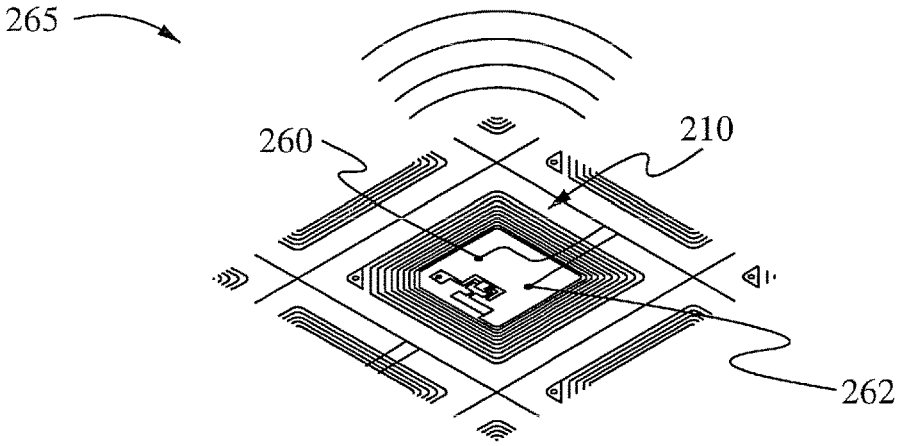
FIG. 2D illustrates an active RFID reader and electrical contacts according to some embodiments.
Figure 2E:
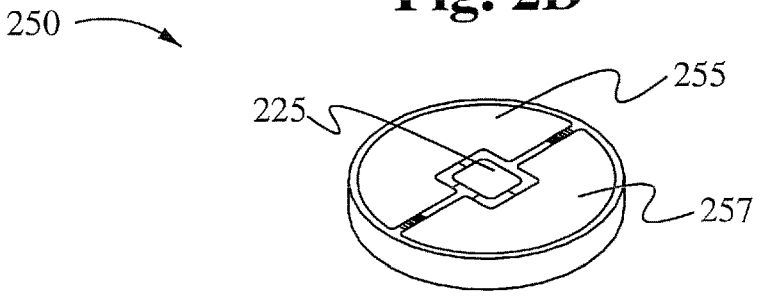
FIG. 2E illustrates an object with an RFID tag and electrical contacts according to some embodiments.
Figure 2F:
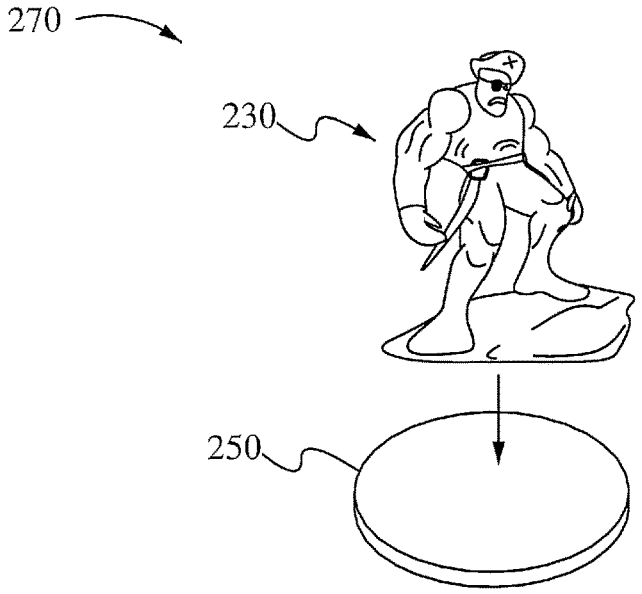
FIG. 2F illustrates an existing game piece mounted on an object containing an RFID tag with electrical supply contacts to the object according to some embodiments.

FIG. 2D illustrates a sensor with a power supply 265 according to some embodiments. A sensor with a power supply 265 comprises a RFID reader 210 and positive and negative electrical contacts 260 and 262. According to some embodiments, FIG. 2E illustrates a powered object 250 comprising either a passive or active RFID tag 225, and hemispherically shaped electrical contact plates 255 and 257. The exact shape of the electrical contact plates 255 and 257 is able to vary, so long as the electrical contact plate shape accommodates a substantial variability in orientation of the powered object 250 placed on the powered sensor 265 electrical contacts 260 and 262. FIG. 2F illustrates affixing the powered object 250 to an existing game piece miniature 230 to create a powered intelligent game piece object 270 according to some embodiments. The powered object 250 is lightweight, and thus any readily available adhesive will serve to affix the powered object 250 to the existing game piece miniature 230.

Figure 2G:
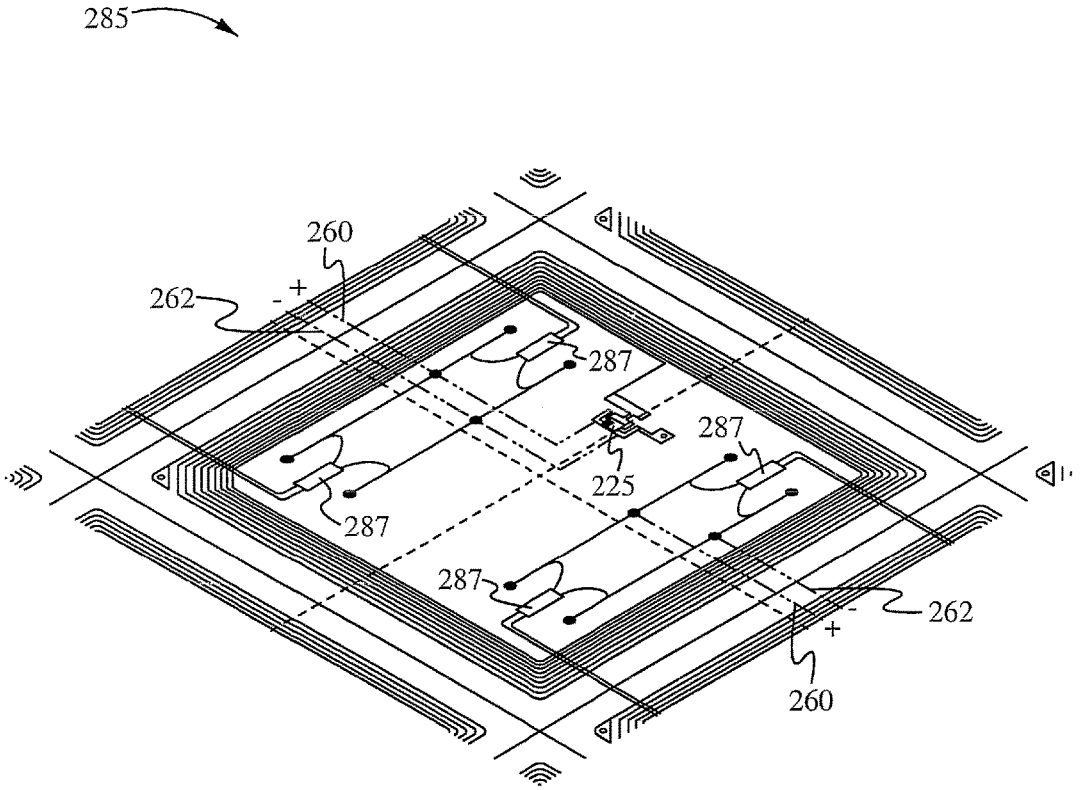
FIG. 2G illustrates an object containing an active RFID reader and Hall-effect sensors with electrical supply contacts according to some embodiments.

FIG. 2G illustrates one or more sensors according to some embodiments. The sensors comprise one or more sensors of a first type and one or more sensors of a second type. The functionality of the sensors of the first type and the sensors the second type are able to differ. In some embodiments, sensors of the first type are sensors which detect at least the presence of an object, such as a Hall-effect sensor, an opto-detector, a mechanical switch such as a pogo-pin, or an electrical contact such as making or breaking a circuit. Sensors of the second type are, for example, RFID readers, or bar code scanners. Embodiments of this type use the sensors of the first type to detect the presence of an intelligent game piece object and use the sensors of the second type to obtain object information. In some embodiments, one or more sensors comprise a sensor of the first type for each location for which detection of an object's presence is desired, and subsequently apply power to the powered intelligent game piece object to enable transfer of its object information to a single sensor of the second type. Sensors of the second type include RF transceivers, wireless 802G receivers, pulsed infra-red light receptors and serial communications modules.

Figure 2H:
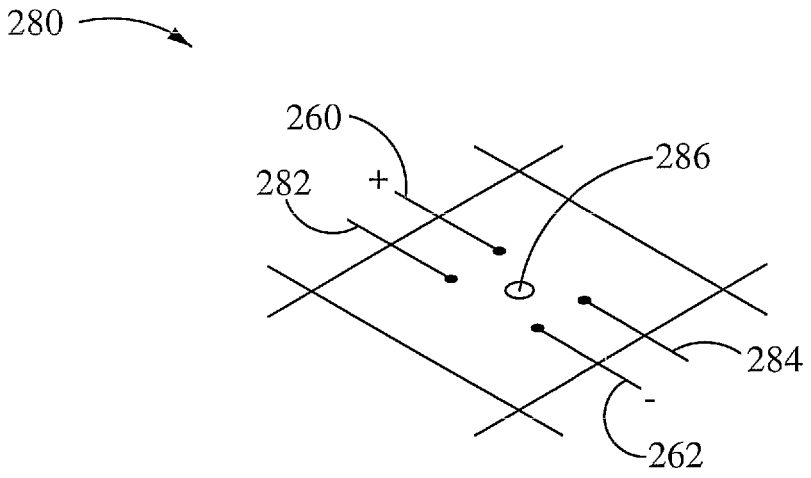
FIG. 2H illustrates a sensor with an optical detector, electrical supply contacts and communication contacts according to some embodiments.
Figure 2I:
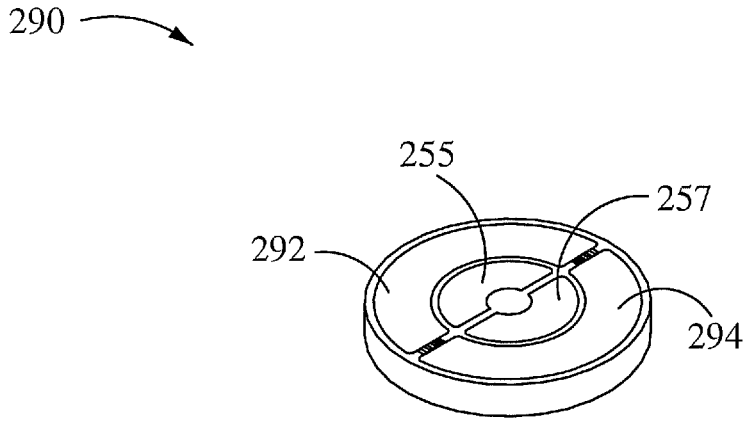
FIG. 2I illustrates an object with electrical contacts and communication contacts according to some embodiments.

FIG. 2H illustrates a diagram of a sensor according to some embodiments. An optical powered sensor 280 comprises electrical contacts 260 and 262, communications contacts 282 and 284, and an opto-detector 286. The opto-detector 286 is a sensor of the first type, as described above. The opto-detector 286 detects the presence of a powered object 290 by occlusion of light when a powered object 290 is placed on a sensor 280. Power is then applied to the powered object 250 via the electrical contacts 260 and 262. On "wake-up" of the processor or controller 610 on the intelligent game piece object 600, or by polling by the interface electronics 115 or by the controller 110, the processor or controller 610 (FIGS. 6B and 6C) drives a message onto the communication pin 292 thereby transmitting object information to a sensor of the second type. In some embodiments, a sensor of the second type is able to be a single serial communications circuit. FIG. 2I illustrates a diagram of a powered intelligent game piece object 290 according to some embodiments. The powered object 290 is able to be used with sensors of two types as described above. One skilled in the art would recognize that a wide variety of sensors of the second type (communication) are contemplated. Further, one skilled in the art would recognize that a wide variety of sensors of the first type (presence) are also contemplated.

In the description which follows, the term "sensor" will refer to a sensor 120 or powered sensor 265 or 280, unless a distinction is noted. The term "object" will refer to an object 215 or a powered object 250 or 290 unless a distinction is noted. The term "intelligent game piece object" will refer to intelligent game piece object 235 or powered intelligent game piece object 270, unless a distinction is noted.

Figure 3:
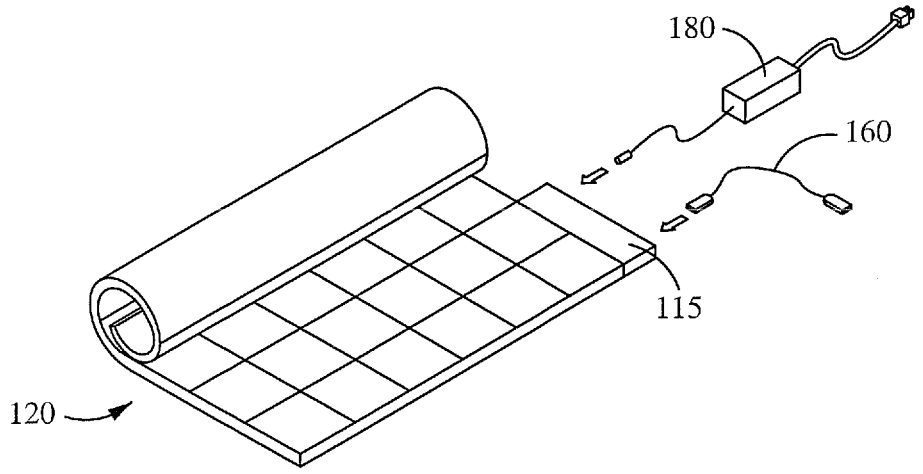
FIG. 3 illustrates a flexible version of the one or more sensors according to some embodiments.

FIG. 3 illustrates one or more sensors according to some embodiments. The sensors are able to be encased in a flexible, portable structure enabling the sensors to be conveniently rolled up for easy transportation. In some embodiments, an AC power adapter 180 supplies low voltage power to the sensors and to the interface electronics 115. In other embodiments, a battery or power storage system is used to provide power to the sensors and to the interface electronics 115. The sensor interface cable 160 couples the interface electronics 115 to the controller 110.

Figure 4:
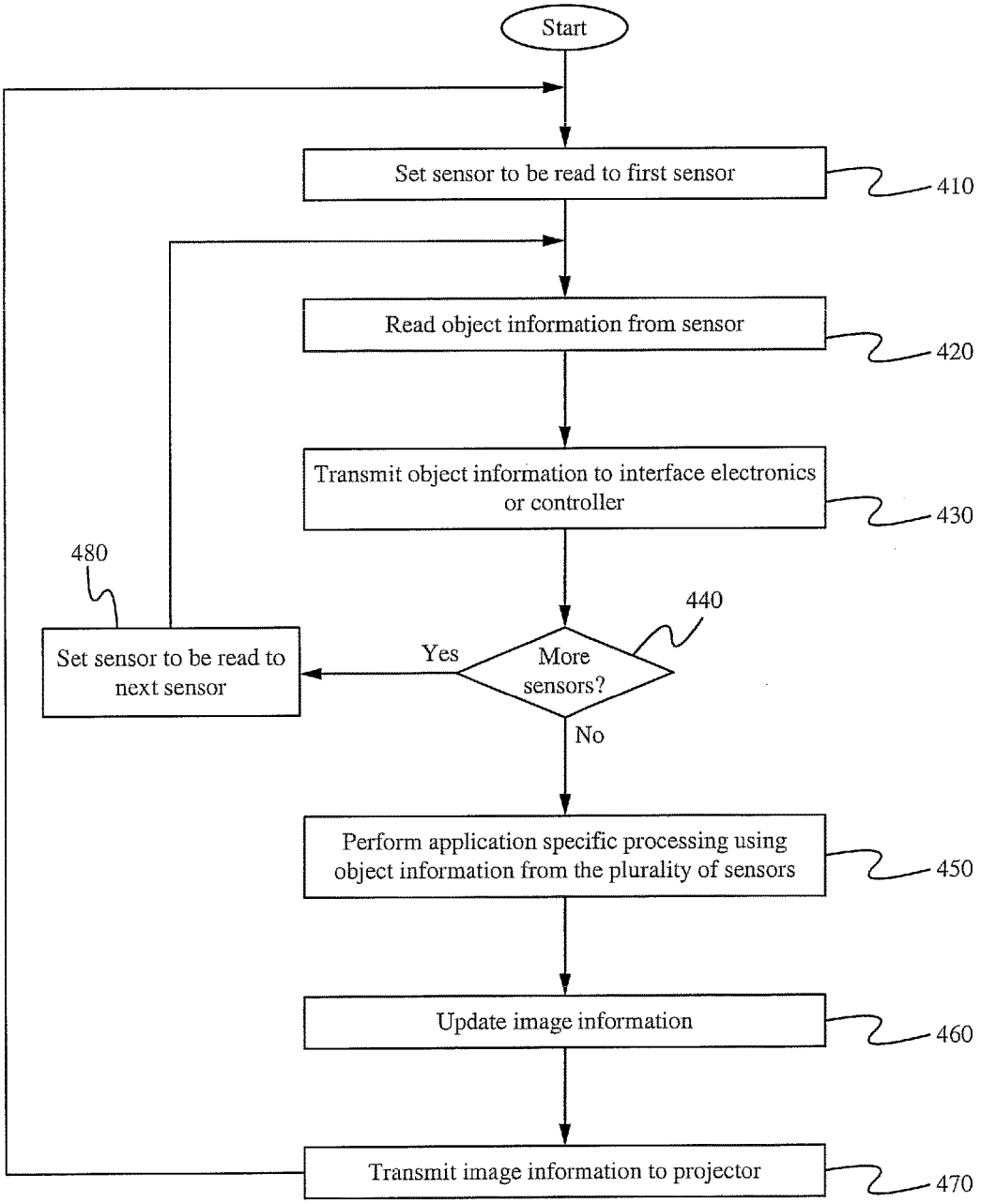
FIG. 4 illustrates a process to update a changing image in response to changes in an object's location based on object information obtained from the sensors.

FIG. 4 illustrates a method of updating a changing image and transmitting the image to a projector 130 according to some embodiments, using sensors of only one type. It will be recognized by one skilled in the art, that the method described below is able to be implemented within the controller 110, the interface electronics 115, or the combined interface electronics and controller 118. At step 410, the sensor to be read is set to the first sensor. In some embodiments, the sensor to be read is determined by a sensor address. In some embodiments, the sensor to be read is determined by other identification methods, such as a name, time slot, or mapping of the sensor to an input port of the controller. Object information is read from the sensor at step 420. The object information is then transmitted to the interface electronics or controller at step 430. At step 440, if there are more sensors to read, then the method branches to step 480 to set the sensor to be read to the next sensor, then the method continues at step 420. If there are no more sensors to read at step 440, then the application software processes the object information at step 430, and updates the image at step 460. The controller then transmits the image to the projector at step 470. The core game features of an intelligent game system are performed in the application software. Such features include producing graphics and sound, scoring points for game play, and executing the game in accordance with the game rules.

Figure 5:
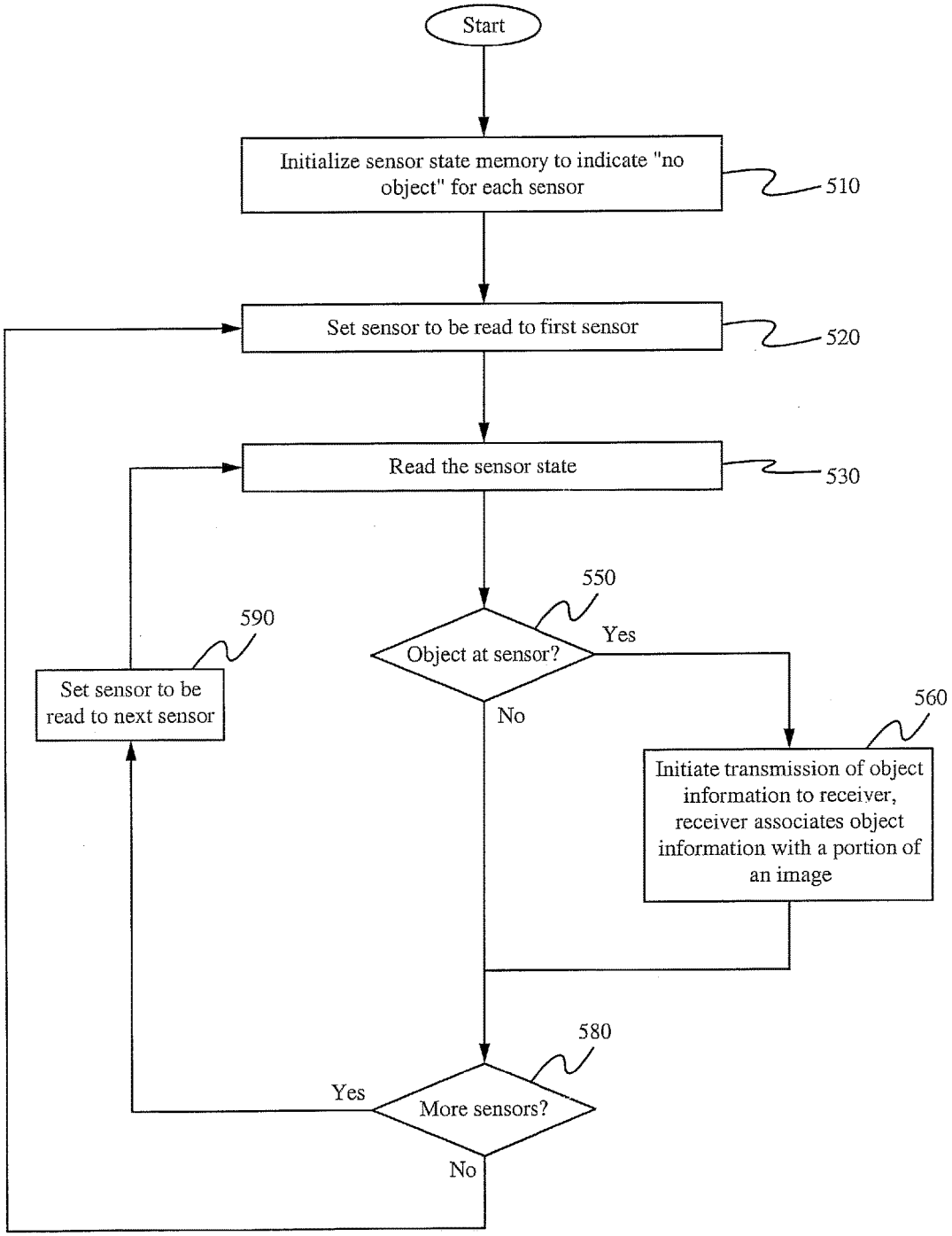
FIG. 5 illustrates a process to associate object information with a portion of an image using one or more sensors.

FIG. 5 illustrates a method of obtaining object information using sensors of two types according to some embodiments. At step 510, a memory to store the state of sensors of the first type is initialized to indicate that "no object" is present at each sensor. At step 520, the sensor to be read is set to the first sensor of the first type. The sensor is read at step 530. If the sensor state has changed at step 540, if an object is detected at the sensor of the first type in step 550, then the object at the sensor initiates transmission of its object information to a sensor of the second type at step 560. The receiver associates the object information with a portion of an image. If no object is at the sensor, then any object information stored for the sensor is deleted at step 570. At step 580, a check is made as to whether there are more sensors. If there are more sensors to check, the sensor to be read is set to the next sensor of the first type, and the sensor is read at step 530. If there are no more sensors to read at step 580, the method continues at step 520 where the sensor to be read is set to the first sensor of the first type.

Intelligent Game Piece Object

Figure 6B:
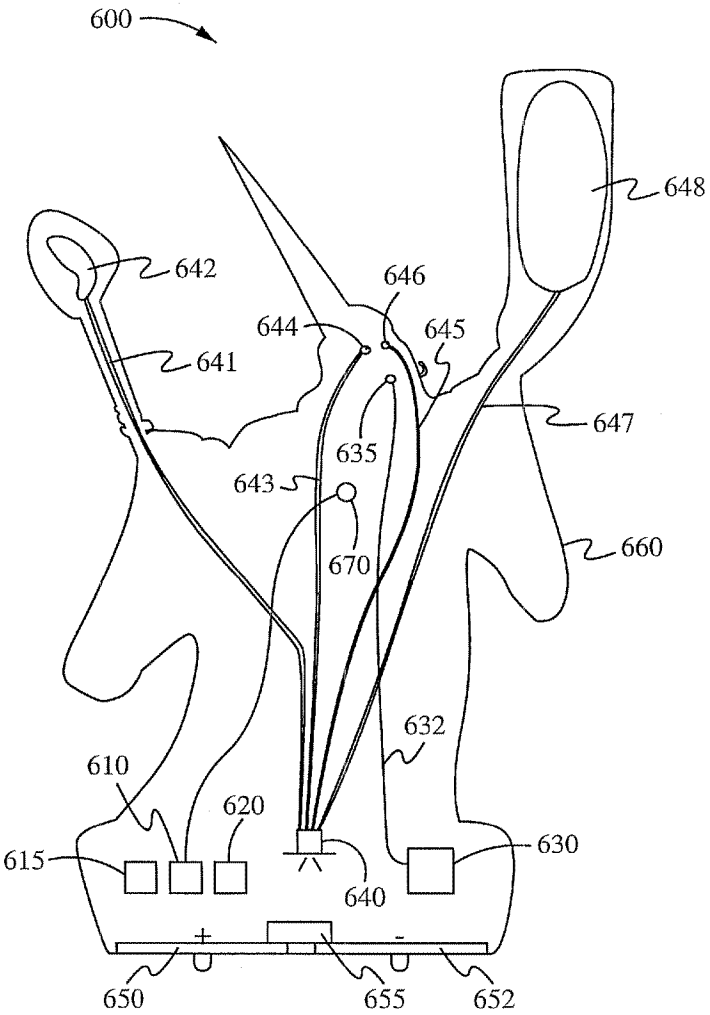
FIG. 6B illustrates an intelligent game piece object according to some embodiments.
Figure 6A:
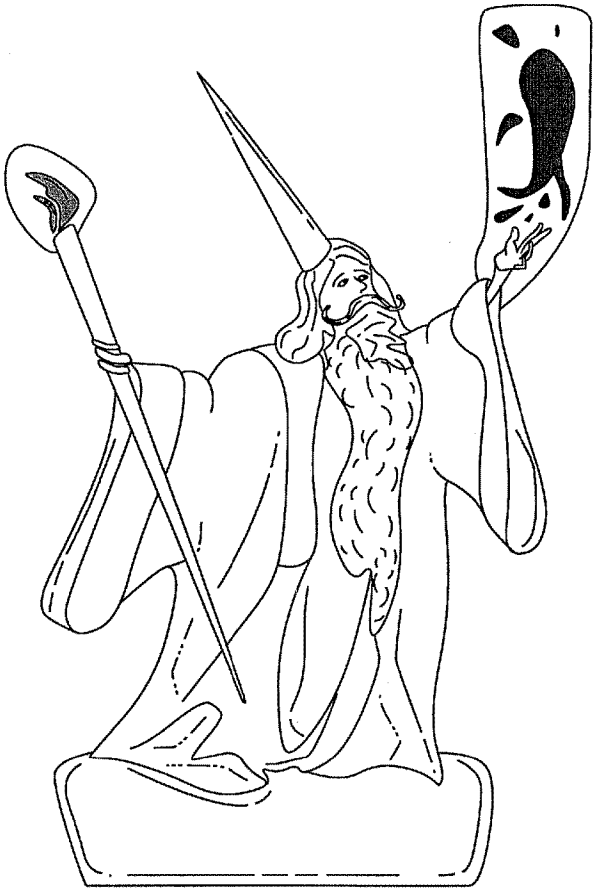
FIG. 6A illustrates a game piece character.

FIG. 6A illustrates an external view of an intelligent game piece object 600. FIG. 6B illustrates internal elements of an intelligent game piece object in accordance with some embodiments. Internal elements of an intelligent game piece object 600 comprise a processor or controller 610. In some embodiments, the intelligent game piece object 600 further comprises one, or more, of a nonvolatile memory 615, a transceiver 620, an audio processor 630, audio distribution equipment 632 and 635, a light emitting source 640, one or more light transmitters 641, 643, 645 and 647, and light diffusers 642, 644, 646 and 648. An intelligent game piece object 600 is able to further comprise an opto-detector 670. The intelligent game piece object 600 further comprises power source contacts 650 and 652. In some embodiments, all components inside the intelligent game piece which require a power source are electrically coupled to the power source contacts 650 and 652. In other embodiments, one or more components of the intelligent game piece object 600 which require a power source are electrically coupled to a battery 655. The processor or controller 610 implements the intelligence of the intelligent game piece object 600. The external features of the intelligent game piece object are embodied in the external skin 660.

Processor

The processor or controller 610 advantageously coordinates the functionality in the intelligent game piece object 600. In some embodiments, the transceiver 620 is operably coupled to the processor or controller 610 to manage transmission and reception of messages. In some embodiments, the audio processor 630 is operably coupled to the processor or controller 610 so that processor or controller 610 is able to configure the audio processor 630 and send the audio processor content and effects for audio processing. In some embodiments, the light emitting source 640 is operably coupled to processor or controller 610 to control the delivery of light.

In some embodiments, the processor or controller 610 comprises a memory store for storing the executable instructions and program variables required to implement the functionality of the intelligent game piece object 600.

Communications

In some embodiments, an intelligent game piece object 600 comprises a communications transceiver 620. The transceiver 620 implements communications between the intelligent game piece object 600 and a receiver of intelligent game piece object information. In some embodiments, a corresponding transceiver is located within the sensors as a sensor of the second type. In other embodiments, the corresponding transceiver is located within the controller 110 (FIG. 1C). The corresponding transceiver is also able to be a wireless router 150 (FIG. 1C). It will be clear to one skilled in the art that the transceiver 620 is able to be a subsystem of the processor or controller 610, or of other elements within the intelligent game piece object 600.

Light Feature

In some embodiments, the intelligent game piece object 600 further comprises a light emitting source 640. The light emitting source 640 comprises, for example, a broadband light bulb, a single wavelength LED or a multi-wavelength LED. In some embodiments, the wavelengths include one or more non-visible wavelengths. The light emitting source 640 is optically coupled to one or more optical transmitters 641, 643, 645, and 647 to distribute light throughout the intelligent game piece object 600. In some embodiments, the optical transmitters include optical fiber of material type and diameter as appropriate for the application and the wavelength transmitted. In some embodiments, the optical transmitters include one or more mirrors. The mirrors are able to be conventional mirrors, precision optics, or micro-mirror arrays. In some embodiments, the one or more optical diffusers 642, 644, 646 or 648 include an opaque or diffusive material of any type such as a polymer resin, frosted glass, or plastic. An optical diffuser is able to be a micro-mirror array for distributing light in a programmable manner.

In some embodiments, the processor or controller 610 selects the wavelength of a multi-wavelength light source 640, or selects from the plurality of light transmitters 641, 643, 645, or 647, determines the on/off time of the light emitting source 640, or provides a pulse train to pulsewidth modulate the light emitting source 640. In some embodiments, the opto-detector 670 is managed by the processor or controller 610 to coordinate with other features of the intelligent game piece object 600 to implement unique game functionality. For example, an intelligent game piece object 600 with an 800 nm (non-visible) light emitting source and an opto-detector 670 which is sensitive to 800 nm light is able to cooperate with the processor or controller 610 to rotate the intelligent game piece object 600 while emitting 800 nm light from the light emitting source 640, and monitoring the opto-detector 670 for reflection of 800 nm light to determine when to stop rotating the intelligent game piece object 600 such that it is facing an opponent's intelligent game piece object.

Sound Feature

In some embodiments, an intelligent game piece object 600 comprises an audio processor 630 which is operably coupled to an audio speaker 635. An audio speaker 635 is able to be a piezo-electric transducer, a conventional cone speaker with magnet and diaphragm, or other suitable audio delivery equipment. Although FIG. 6B shows a single audio speaker 630, located at the mouth of the character of the intelligent game piece object 600, additional or alternate audio configurations would be contemplated by one skilled in the art. In some embodiments, the audio speaker 635 is located in the base, and the audio distribution equipment 632 comprises a hollow tube directed to the location where the audio is to be delivered. In some embodiments, the audio distribution equipment 632 comprises an electrical cable pair, distributing audio to one or more audio speakers 635. In some embodiments, the processor or controller 610 generates audio within the intelligent game object incident to the movement and optical sensing. In some embodiments, the audio processing comprises audio effects such as echo, reverb, phase shifting. In some embodiments, audio processing techniques are implemented in the processor or controller 610 where the processor or controller 610 comprises digital signal processing functionality.

Movement Feature

Figure 6C:
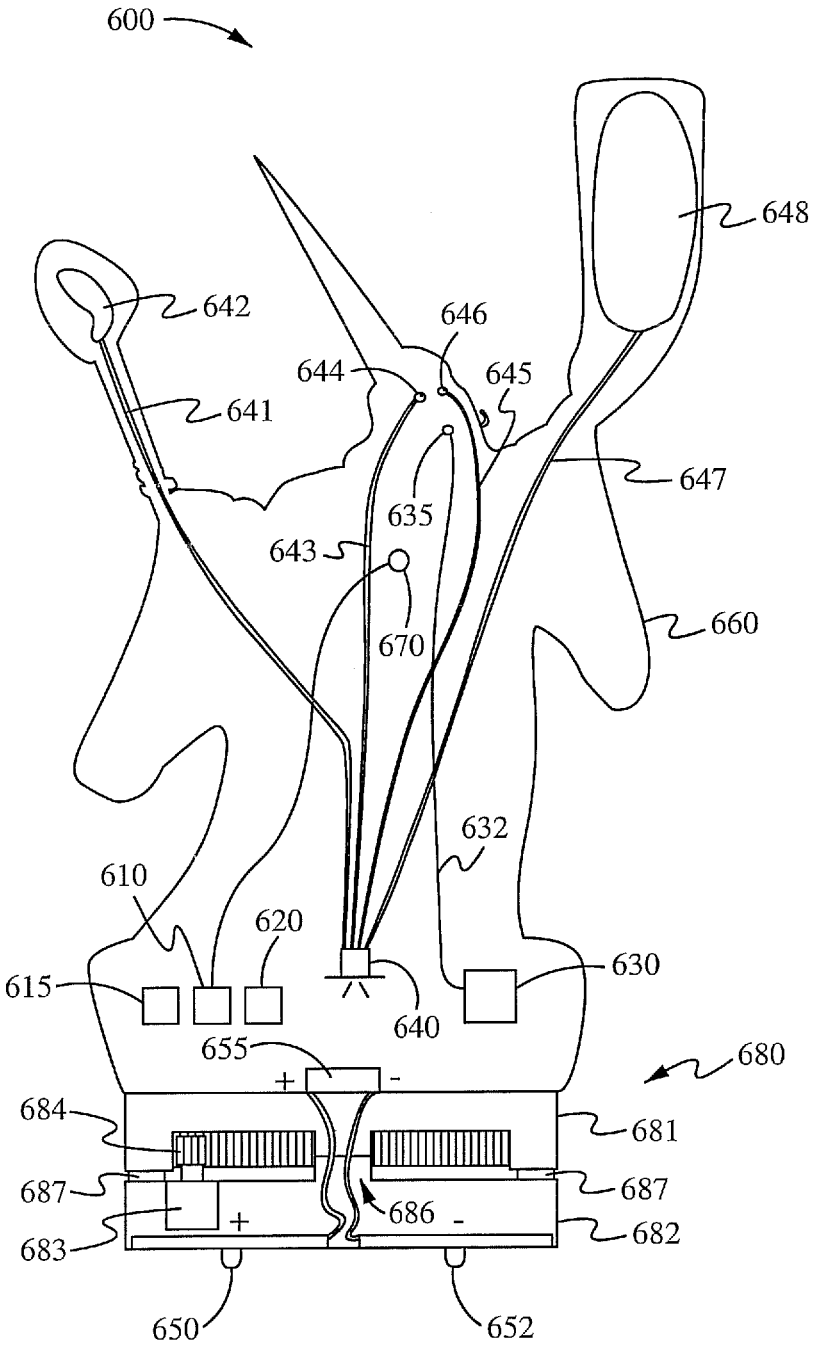
FIG. 6C illustrates a rotating base for a powered intelligent game piece object according to some embodiments.

FIG. 6C illustrates a rotating base for a powered intelligent game piece object according to some embodiments. The rotating base 680 comprises a top half of the base 681 and a bottom half of the base 682, rotatably coupled via a pivot 686. The top half of the base 681 is driven by a motor 683 in the bottom half of the base 682. The motor has a driving gear head or friction capstan drive 684 which drives the top half of the base 681. The top half of the base 681 has ring gear teeth corresponding to the driving gear head, or a friction surface to mate to the friction capstan drive. In some embodiments, the top and bottom halves of the rotating base further comprise a plurality of support bearing surfaces 687. Power is supplied via the electrical contacts 650 and 652, as described above.

Nonvolatile Memory

In some embodiments, an intelligent game piece object comprises a nonvolatile memory 615. The nonvolatile memory 615 stores persistent object information such as a unique identifier, a name, special powers, score count, injury statistics, light and/or audio processing algorithms and other object information. FIGS. 7A through 7E illustrate partial memory maps of nonvolatile storage, assuming 128 registers of 16-bits each. The memory maps and values are merely illustrative. It will be recognized by one skilled in the art that a wide variety of memory maps are able to be used, so long as minimum functionality includes a unique identifier for the intelligent game piece object. Further, it will be recognized by one skilled in the art that the nonvolatile memory is able to be a subsystem of the processor or controller 610, or a subsystem of another integrating circuit, such as the audio processor 630 or transceiver 620.

Methods of Intelligent Game System Play

Figure 8A:
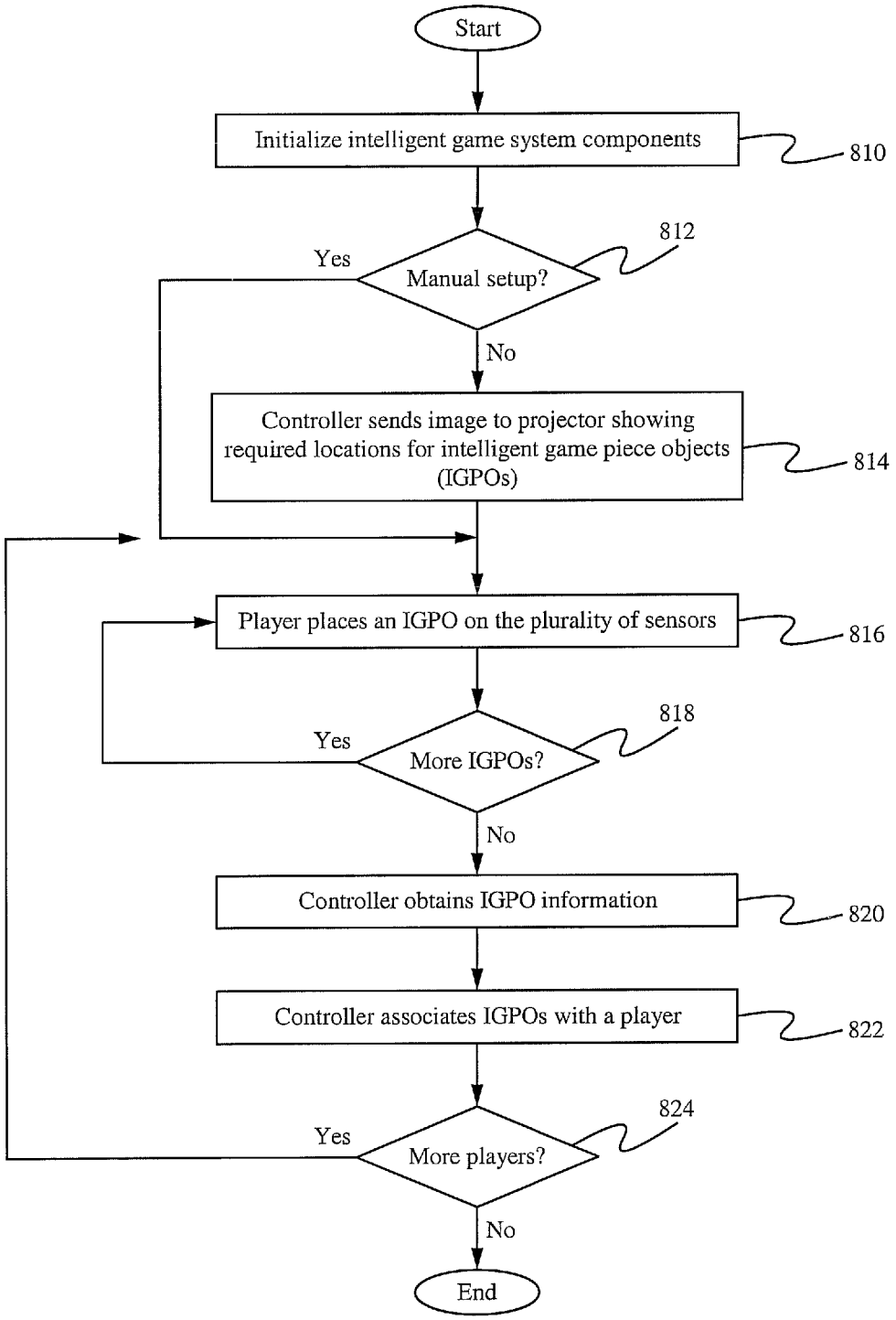
FIG. 8A illustrates a method of initializing an intelligent game system when starting a new game.

FIG. 8A illustrates a method of initializing game play for the start of a new game using an intelligent game system. At step 810, all intelligent game system components are initialized. At step 812, the user is presented with a decision whether they want to perform game piece setup manually, or automatically. If the user opts for automatic game piece setup, then at step 814 the controller sends an image to the projector to project onto the surface of the sensors, showing where the intelligent game piece objects are to be initially placed to begin game play. If the user opts for manual game piece setup, or following projection of the required game piece object locations for automatic game piece setup, then at step 816 the player(s) place intelligent game piece objects on individual sensor locations within the sensors. The placement of intelligent game piece objects onto the surface of the sensors continues until, at step 818, it is determined that no more game piece objects need to be placed. At step 820, the controller obtains intelligent game piece information from the intelligent game piece objects. At step 822, the intelligent game piece objects are associated with a player. At step 824, if another player's objects have not yet been placed, the process resumes at step 816, otherwise the process terminates.

Figure 8B:
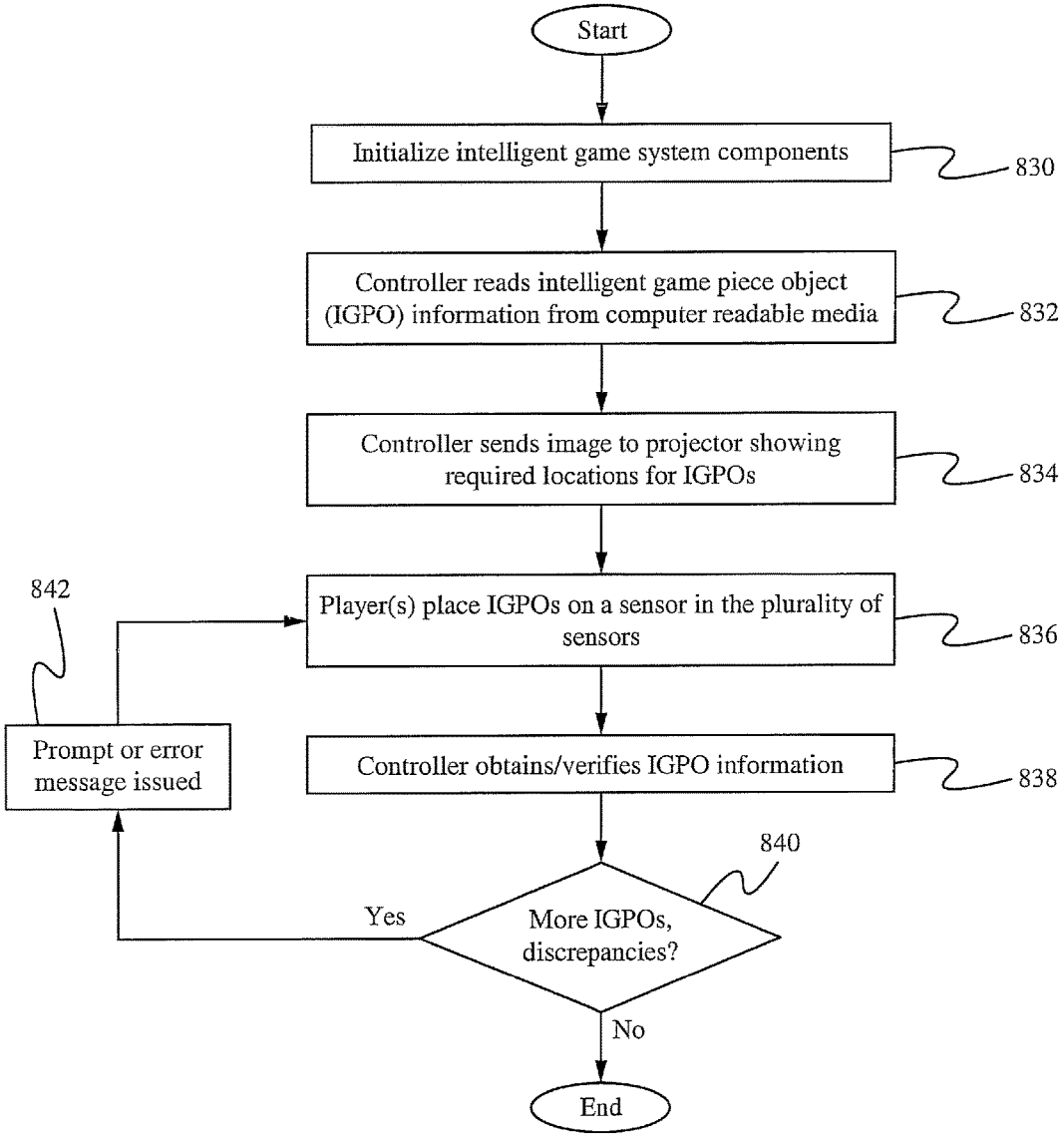
FIG. 8B illustrates a method of initializing an intelligent game system when resuming a game in progress using a computer readable media.

FIG. 8B illustrates a method of initializing game play for the resumption of a game in progress using an intelligent game system. At step 830, all intelligent game system components are initialized. At step 832, the controller reads intelligent game piece object information from a computer readable media. At step 834, the controller sends an image to the projector showing required locations for intelligent game piece objects to resume a previous game in progress. At step 836, a player places intelligent game piece objects on the sensors in the locations specified by the projected image. At step 838, the controller verifies the placement of intelligent game piece object(s). If it is determined at step 840 that there are more intelligent game piece objects to place, or that one or more intelligent game piece objects are placed on incorrect sensor(s), then a prompt or error message is issued and the process continues at step 836. One skilled in the art would recognize that the prompt or error message is able to be visual, displayed on the controller on via the projector, or audio, such as a spoken message, or any other relevant signal generated with the intelligent game system or the intelligent game piece objects. For example, an intelligent game piece object comprising a sound feature is able to direct the player to correct the intelligent game piece placement by a specific sound. An intelligent game piece object comprising a light feature is able to direct the player to correct the intelligent game piece placement by a specific sequence or pattern of illumination.

Figure 8C:
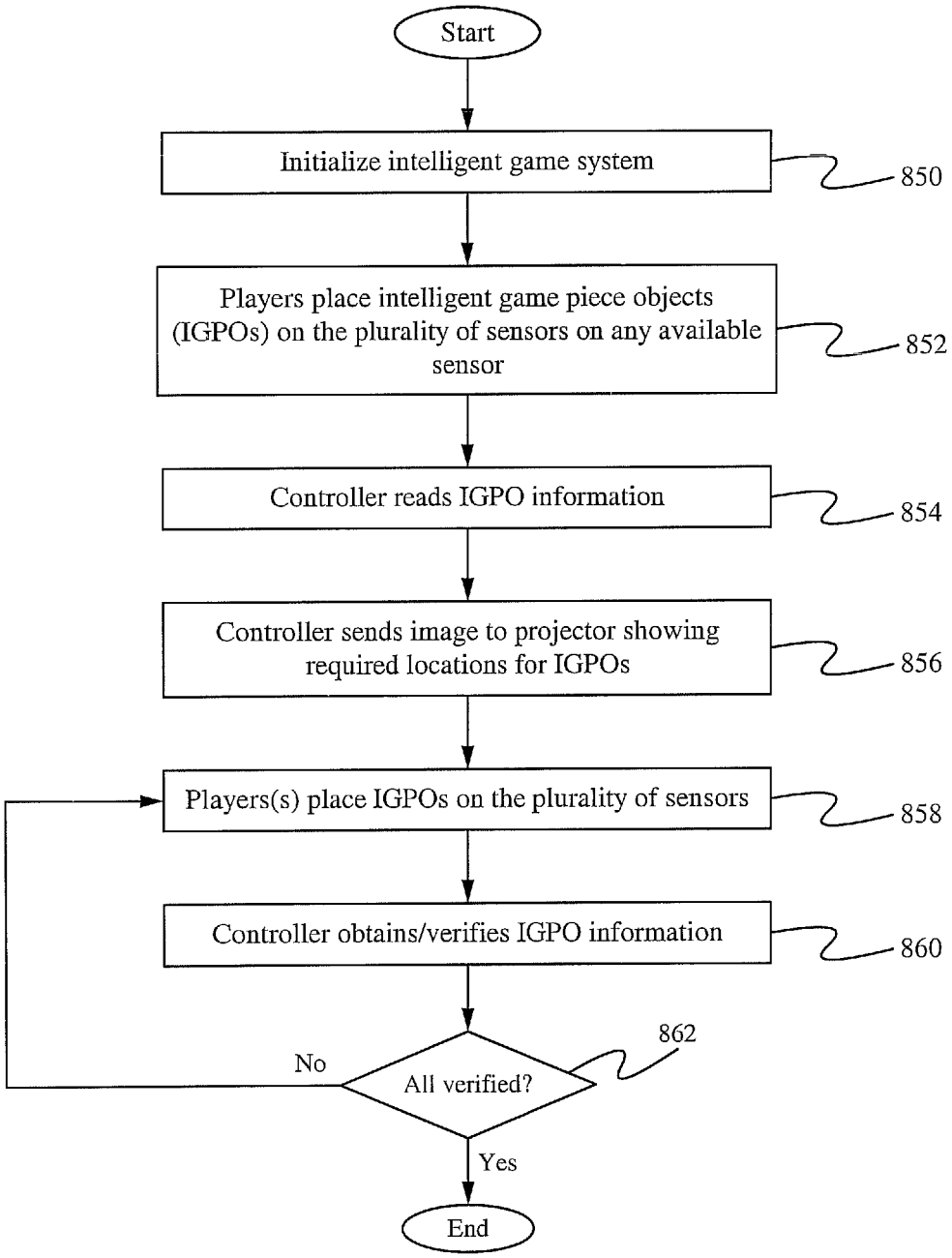
FIG. 8C illustrates a method of initializing an intelligent game system utilizing intelligent game piece object information stored within the intelligent game piece objects.

FIG. 8C illustrates a method of initializing game play for resumption of a game in progress using an intelligent game system according to some embodiments. At step 850, the intelligent game system hardware is initialized. Player(s) place intelligent game piece objects on the sensors at step 852, on any available sensor. Players are able to choose to place the intelligent game piece objects at, or near, where they remember them to be from the prior session of the game in progress. But, any available sensor will do. When the placement of intelligent game piece objects is completed, at step 854 the intelligent game system reads intelligent game piece object information from the intelligent game piece objects where the information comprises the unique identifier and sensor identifier stored in the intelligent game piece object during the prior session of the game in progress. At step 856, the controller sends an image to the projector showing required locations for the intelligent game piece objects. At step 858, player(s) then relocate intelligent game piece objects to the locations shown by the projected image. The controller obtains and verifies the placement of intelligent game piece objects at step 860. When the placement of all intelligent game piece objects has been verified, the process terminates at step 862.

Figure 8D:
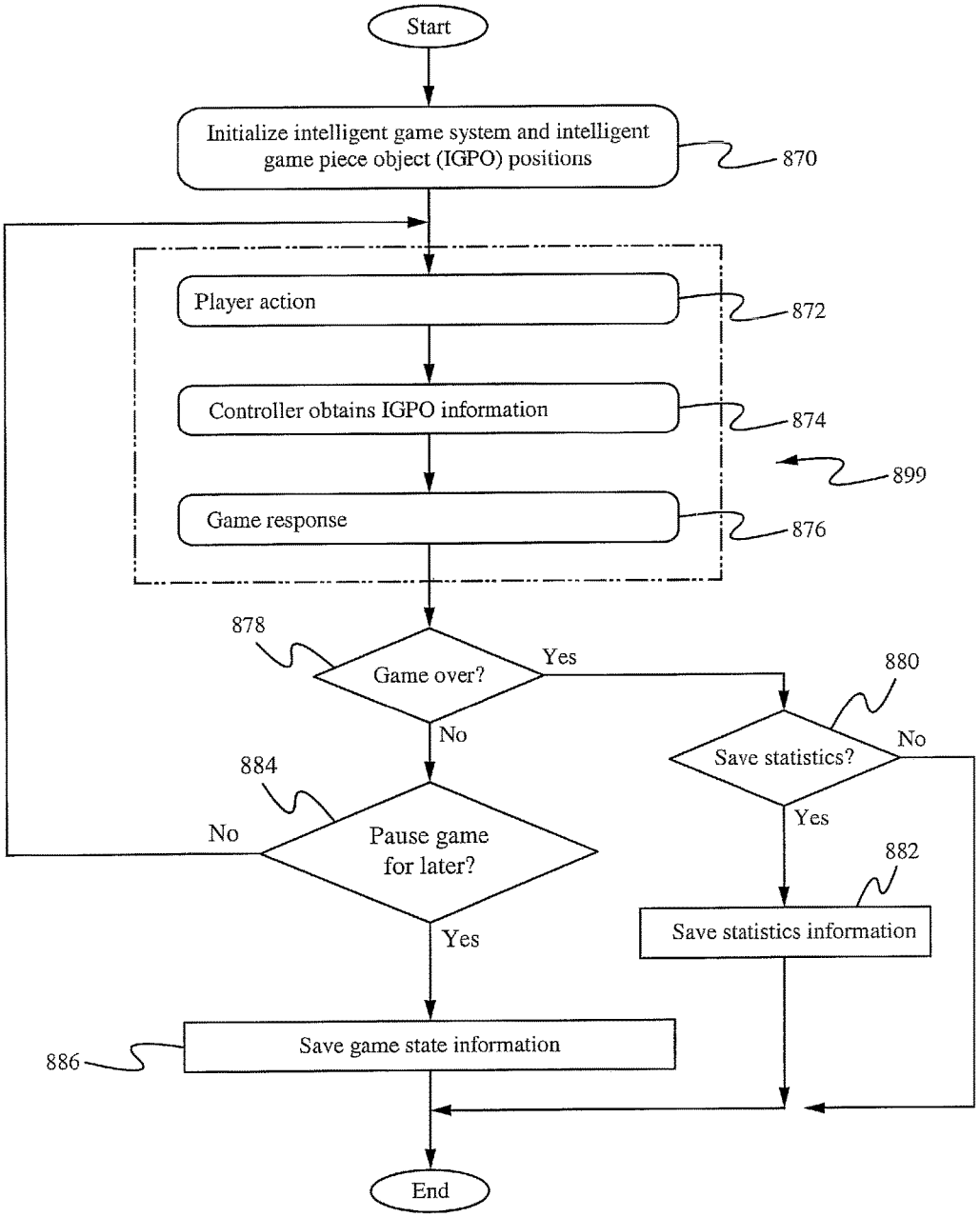
FIG. 8D illustrates a method of playing a game on an intelligent game system.

FIG. 8D illustrates an overview of game play of a generic game. The specific game logic, scoring, movement of players and other game specific-features is a function of the game application software, utilizing the intelligent game system and intelligent game piece object functionality. Step 899, shows the basic game engine, comprising player action, obtaining object information from intelligent game piece objects, and a game response. Starting the game at step 870, the game is initialized. Initialization of game play in an intelligent game system is able to be in accordance with FIGS. 8A through 8C, above. FIGS. 8A through 8C are illustrative of a process of game play initialization in an intelligent game system. At step 872, a player takes a player action. A player action is able to comprise the physical movement of an intelligent game piece object to another sensor in the sensors, or a player action is able to be an invocation of a game function or intelligent game piece object feature through any available input device in the intelligent game system. At step 874, the controller obtains intelligent game piece object information. At step 876, the game application software produces a response to the player action. Such a response is able to include sound and/or graphics.

At step 878, if the game is over, then the method branches to step 880, where the user is prompted whether the intelligent game system is to save game statistical information. At step 882, statistical information is saved. Such statistical information comprises information such as scoring information, location of intelligent game piece objects, and current dynamic information for intelligent game piece objects. In some embodiments, intelligent game piece object dynamic information comprises such items as weapon count, current stamina, injury statistics, accessory count and other game piece specific information. In an intelligent game piece object comprising nonvolatile memory, intelligent game piece-specific information is able to be stored within the intelligent game piece object. In some embodiments, all game play and intelligent game piece information is stored on a computer readable media. The computer readable media is able to be located within the controller, external to the controller, or is able to be a removable computer readable media. The statistical information is also able to be transmitted via network, or by email, to a remote destination for later use. If the game is not over, then a player is able to opt to pause the game in progress for later play at step 884. If the player opts to pause the game, then game state information is saved at step 886, otherwise play continues at 872. Game state information comprises any, or all, of the information described above in step 882 where statistical information is saved. In addition, if relevant, intelligent game piece object information indicating the identifier of the sensor at which each intelligent game piece object is presently positioned is stored. As with statistic information, the location of intelligent game piece objects is able to be stored in computer readable media in the controller, or a removable computer readable media, within nonvolatile storage within the intelligent game piece objects, or transferred by network to a remote server or by email.

It will be understood by those skilled in the art that the players are able to use intelligent game piece objects, or virtual game piece objects. Virtual game piece objects are projected onto the surface of the sensors. Thus, a virtual player is able to be, for example, the controller or a live game player accessing the intelligent game system via a network. Further, all players are able to be virtual players, such as for demonstrating a training mode or arcade mode where the game plays against itself, using virtual game piece objects to demonstrate game play or to attract players to the game by demonstrating its features and game play. Since the virtual players are mere images whose location is determined by the controller, intelligent game piece objects and virtual game piece objects are able to occupy the same sensor location.

In operation, a system for putting intelligence into board and tabletop games including miniatures comprises a game play surface including sensors capable of identifying the location and unique identity of game pieces on the game play surface. Each sensor in the game play surface corresponds to a portion of an image to be displayed by an overhead projector onto the game play surface. Interface electronics coupled to the game play surface read the sensors comprising the game play surface. Each sensor reading comprises an identifier of the sensor and at least an identifier of a game piece on the sensor, if a game piece is present on the sensor. For each sensor in the game play surface, the interface electronics pass the sensor identifier and the identifier of any game piece on the sensor, to the controller. The controller comprises a computer readable media programmed with a game application software. The game application software receives the sensor identifier and game piece identifier for each sensor and utilizes the information to maintain scoring of the game and provide enhanced game play features.

The controller further comprises an interface for transmitting the game play image to an overhead projector such as a DLP® or LCD projector. The controller further comprises an interface for transmitting sound to a sound system or speakers connected to the controller. Enhanced game play features include graphics projected onto the game play surface and sounds transmitted to the sound system or speakers to enhance the game playing experience. Game logic includes scoring, enabled by the controller's awareness of the location and identification of game pieces on the game play surface. Information gathered from the sensors comprising game state information, game play statistics, and game piece information are able to be stored to a computer readable media within the controller, or a removable computer readable media, to enable users to resume a game in progress at a later time or on a different system and to maintain statistics of game play and statistics for individual game pieces.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications are able to be made in the embodiment chosen for illustration without departing from the spirit and scope of the invention as defined by the claims.

What is claimed is:

1. An intelligent game system comprising:

a game object including a memory storing object information and a transmission circuit;

a sheet formed by an array of abutting sensor modules including a reading circuit to obtain the object information from the game object when placed on the sheet; and a controller coupled to each of the sensor modules to receive the object information, wherein the controller transmits a read signal to the game object via one or more of the sensor modules, and further wherein the game object transmits a response signal to the controller in response to the read signal.

2. The intelligent game system as claimed in claim 1, wherein each sensor module has an address.

3. The intelligent game system as claimed in claim 1, wherein each sensor module has a unique name.

4. The intelligent game system as claimed in claim 1, wherein each sensor module is associated with a unique time slot, wherein the controller retrieves the object information from each sensor module per processing cycle at the time of the cycle indicated by the time slot.

5. The intelligent game system as claimed in claim 1, wherein each sensor module is mapped to an input port of the controller.

6. The intelligent game system as claimed in claim 1, wherein each sensor module is associated with a portion of an image.

7. The intelligent game system as claimed in claim 1, further comprising interface electronics coupled to receive the object information from each sensor module, and the controller is coupled to the interface electronics to receive the object information.

8. The intelligent game system as claimed in claim 1, further comprising a computer readable media, programmed with instructions for implementing a game, and configured to be read by the controller.

9. The intelligent game system as claimed in claim 1, wherein the object information is a unique identifier.

10. The intelligent game system as claimed in claim 2, further comprising a projector coupled to receive image information from the controller, wherein the controller processes the object information and the sensor address of each sensor module to update a changing image, and the controller transmits image information to the projector.

11. The intelligent game system as claimed in claim 1, wherein each of the sensor modules comprise a radio frequency identification (RFID) reader and the unique identifier comprises an RFID.

12. The intelligent game system as claimed in claim 1, wherein each of the sensor modules comprise a bar code reader and the unique identifier comprises a bar code.

13. The intelligent game system as claimed in claim 1, wherein the sensor modules comprise one or more of: an opto-detector, a Hall-effect sensor, a switch, or a circuit made or broken.

14. The intelligent game system as claimed in claim 1, wherein the object information comprises a property of an object at the sensor.

15. The intelligent game system as claimed in claim 1, wherein each sensor module further comprises a plurality of electrical supply points.

16. The intelligent game system as claimed in claim 1, further comprising a payment interface for receiving payment for use of the intelligent game system.

17. The intelligent game system as claimed in claim 1, wherein the intelligent game system further comprises sound reproduction equipment, and wherein the controller is configured to transmit audio to the sound reproduction equipment.

18. The intelligent game system as claimed in claim 1, further comprising a communications device operably coupled to the controller for communicating with one or more remote game systems.

19. A method of updating image information and projecting a changing image on a sheet formed by an array of abutting radio frequency identifier reader sensors to obtain object information from one or more movable objects including radio frequency identifier tags placed on the sheet, the method comprising:

a. reading the object information stored on memory of one of the movable objects placed on the sheet above one or more of the one or more sensors with a controller coupled with the sensors by transmitting a radio frequency read signal from the one or more of the sensors to the radio frequency identifier tag of the one of the movable objects and receiving a radio frequency response signal from the tag;

b. associating the object information with a portion of an image that the one or more of the sensors correspond to with the controller;

c. performing application specific processing with the controller using the object information;

d. adjusting each portion of the image with the controller based on the associated object information, wherein the adjusted portions of the image form a changed image; and e. transmitting the changed image with the controller to a projector and projecting the changed image onto the top surface of the game board with the projector.

20. The method as claimed in claim 19, wherein each sensor corresponds to a portion of an image.

21. The method as claimed in claim 19, wherein each sensor has an address and each address corresponds to a portion of an image.

22. The method as claimed in claim 19, wherein reading the object information from a sensor is conditioned on the presence of the one of the movable objects at the sensor.

23. The method as claimed in claim 19, wherein the object is a game piece and the information is a unique identifier.

24. The method as claimed in claim 23, wherein the unique identifier is a RFID.

25. A method of obtaining object information using a plurality of abutting sensors that together form a game board, each sensor having a state indicating the presence of an object, the method comprising:

a. associating each of the plurality of sensors with a different location on the game board and a portion of an image with a controller based on the different location;

b. reading the sensor state and a sensor identifier from each of the sensors by transmitting a state signal to the sensors with the controller in a predefined order, wherein the sensor identifier of each of the sensors is stored in a memory within the associated sensor, wherein the predefined order indicates the order in which the sensors are read; and c. if the sensor state indicates the presence of an object, then initiating with the controller a transmission of the object's object information to a receiver by sending a read signal to the object via the sensor.

26. The method of obtaining object information as claimed in claim 25, further comprising: initializing a memory for storing the state of each sensor to indicate that no object is present at the sensor, before reading each sensor for the first time;

comparing the sensor state reading with the sensor state stored in the memory, after reading the sensor state from the sensor;

receiving the object information with the receiver if the sensor state reading indicates that an object is present at the sensor; and updating the sensor state stored in the memory with the sensor state reading.

27. The method of obtaining object information as claimed in claim 25, wherein initiating the transfer of the object's object information to a receiver and the receiver receiving the object information are executed only when the sensor state changes to indicate the presence of an object.

28. A method of playing an intelligent game comprising:

a. initializing intelligent game system components and software with a controller;

b. associating one or more first objects with a first player with the controller;

c. obtaining object information for one or more first objects with the controller using one or more abutting sensors by transmitting a read signal to the one or more first objects via the sensors, wherein the first objects are located on a sheet formed by an array of the sensors with each of the one or more sensors corresponding to a portion of an image;

d. processing the object information for at least one first object with the controller using an application software;

e. adjusting each portion of the image with the controller based on the object information obtained by the corresponding sensors forming a changed image;

f. transmitting the changed image with the controller to an image projector; and g. acquiring and saving the current game state information with the controller in response to pausing of the game.

29. The method as claimed in claim 28 further comprising:

a. associating one or more second objects with a second player;

b. associating the one or more second objects with second object information and associating the second object information with a portion of an image; and c. processing the object information for at least one second object using an application software.

30. The method as claimed in claim 29 wherein the one or more second objects comprise one or more virtual second objects.

31. An intelligent game system comprising:

a. a sheet formed by a plurality of abutting sensor modules to obtain object information from an object positioned on the sheet;

b. interface electronics coupled to receive the object information from each sensor module;

c. a controller coupled to receive the object information of each sensor module from the interface electronics, and to associate the object information with a portion of an image;

d. a computer readable media, programmed with instructions for implementing a game, and configured to be read by the controller;

e. a projector, coupled to receive image information from the controller, wherein the projector receives image information from the controller and projects an image onto the sheet above the sensor modules based on the image information received from the controller; and f. a game piece comprising object information capable of being read by the sensor modules, wherein the object information is an identifier, wherein the controller transmits a read signal to the game piece via one or more of the sensor modules and the game piece transmits a response signal to the controller in response to the read signal.

32. The intelligent game system of claim 31 wherein each sensor module has an address and each sensor address is associated with a portion of an image.

33. The intelligent game system of claim 31 wherein each sensor module corresponds to a portion of an image.

* * * * *